US011905061B2

(12) United States Patent
Curl, Jr. et al.

(10) Patent No.: US 11,905,061 B2
(45) Date of Patent: Feb. 20, 2024

(54) DEVICES FOR CAPPING VIALS USEFUL IN SYSTEM AND METHOD FOR DISPENSING PRESCRIPTIONS

(71) Applicant: PARATA SYSTEMS, LLC, Durham, NC (US)

(72) Inventors: Weldon Curl, Jr., Garner, NC (US); Joe Cross, Raleigh, NC (US)

(73) Assignee: PARATA SYSTEMS, LLC, Durham, NC (US)

( * ) Notice: Subject to any disclaimer, the term of this patent is extended or adjusted under 35 U.S.C. 154(b) by 0 days.

(21) Appl. No.: 17/462,607

(22) Filed: Aug. 31, 2021

(65) Prior Publication Data

US 2022/0073222 A1 Mar. 10, 2022

Related U.S. Application Data

(60) Provisional application No. 63/076,062, filed on Sep. 9, 2020.

(51) Int. Cl.
*B65B 7/28* (2006.01)

(52) U.S. Cl.
CPC ..... *B65B 7/2807* (2013.01); *B65B 7/2835* (2013.01)

(58) Field of Classification Search
None
See application file for complete search history.

(56) References Cited

U.S. PATENT DOCUMENTS

| | | | | |
|---|---|---|---|---|
| 3,835,619 | A * | 9/1974 | Reisman | B65B 7/2842 53/138.2 |
| 5,337,919 | A | 8/1994 | Spaulding et al. | |
| 6,006,946 | A | 12/1999 | Williams et al. | |
| 6,036,812 | A | 3/2000 | Williams et al. | |
| 6,176,392 | B1 | 1/2001 | William et al. | |
| 6,971,541 | B2 | 12/2005 | Williams et al. | |
| 7,387,049 | B1 * | 6/2008 | Ver Hage | B67B 3/2006 81/3.4 |
| 7,581,373 | B2 | 9/2009 | Sink et al. | |
| 7,596,932 | B2 | 10/2009 | Sink et al. | |
| 7,770,358 | B2 * | 8/2010 | Sink | B65B 7/2835 53/367 |
| 8,016,095 | B2 | 9/2011 | Daniels et al. | |
| 8,261,936 | B2 | 9/2012 | Dumond et al. | |
| 8,413,410 | B2 | 4/2013 | Ulm et al. | |
| 2008/0110555 | A1 | 5/2008 | Pollard et al. | |
| 2008/0283179 | A1 | 11/2008 | Sink | |
| 2015/0175398 | A1 * | 6/2015 | Christensen | B67B 3/2066 53/318 |
| 2020/0002031 | A1 * | 1/2020 | Hiramoto | B65B 61/26 |

* cited by examiner

*Primary Examiner* — Tanzim Imam
(74) *Attorney, Agent, or Firm* — Myers Bigel, P.A.

(57) ABSTRACT

An apparatus for securing a cap on a cylindrical container includes: a stage including a receiving region for separately receiving a cap and a container; and an elevator movable upwardly away from the stage and downwardly toward the stage. The elevator includes: a carrier disposed over the stage; a capturing member on the carrier and configured to capture the cap; and at least one extendable member extending from the carrier, the at least one extendable member movable from a home position with the extendable member above a center of the cap and an engagement position with the extendable member engaging the center of the cap and urging the center of the cap downwardly relative to an outer sidewall of the cap.

17 Claims, 26 Drawing Sheets

DEVICES FOR CAPPING VIALS USEFUL IN SYSTEM AND METHOD FOR DISPENSING PRESCRIPTIONS

RELATED APPLICATION

The present application claims priority from and the benefit of U.S. Provisional Patent Application No. 63/076,602, filed Sep. 9, 2020, the disclosure of which is hereby incorporated herein by reference in its entirety.

FIELD OF THE INVENTION

The present invention is directed generally to the dispensing of prescriptions of pharmaceuticals, and more specifically is directed to the automated dispensing of pharmaceuticals.

BACKGROUND

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Drawbacks to these systems typically include the relatively low speed at which prescriptions are filled and the absence in these systems of securing a closure (i.e., a lid) on the container after it is filled.

One additional automated system for dispensing pharmaceuticals is described in some detail in U.S. Pat. No. 6,971,541 to Williams et al. This system has the capacity to select an appropriate vial, label the vial, fill the vial with a desired quantity of a selected pharmaceutical tablet, apply a cap to the filled vial, and convey the labeled, filled, capped vial to an offloading station for retrieval.

Although this particular system can provide automated pharmaceutical dispensing, certain of the operations may be improved. One technique for adding the cap to a filled vial is included in U.S. Pat. No. 7,596,932 to Sink et al. and U.S. Pat. No. 8,413,410 to Ulm et al. The flexibility of this capping operation may be improved and desirable. Also, the ability to accommodate multiple styles and sizes of vials and caps with a single mechanism may also be desirable. Further, some caps allow selection of a child-resistant orientation and a non-child-resistant orientation. It would be useful if the system was able to place the cap in the customer's desired orientation.

SUMMARY

As a first aspect, embodiments of the invention are directed to an apparatus for securing a cap on a cylindrical container. The apparatus comprises: a stage including a receiving region for separately receiving a cap and a container; and an elevator movable upwardly away from the stage and downwardly toward the stage. The elevator comprises: a carrier disposed over the stage; a capturing member on the carrier and configured to capture the cap; and at least one extendable member extending from the carrier, the at least one extendable member movable from a home position with the extendable member above a center of the cap and an engagement position with the extendable member engaging the center of the cap and urging the center of the cap downwardly relative to an outer sidewall of the cap.

As a second aspect, embodiments of the invention are directed to a method comprising: positioning a cap on a stage, the cap comprising a center portion and an outer sidewall portion, the center portion configured to be pressed downward relative to the outer sidewall to place the cap in a non-child-resistant orientation; translating an elevator assembly downwardly toward the stage, the elevator assembly comprising a carrier and at least one extendable member movable from a home position to an engagement position wherein the extendable member is closer to the stage in the engagement position than in the home position; and urging the center portion of the cap downward relative to the outer sidewall of the cap to place the cap in the non-child-resistant orientation by actuating the at least one extendable member from the home position to the engagement position.

DETAILED DESCRIPTION

Figure 1:
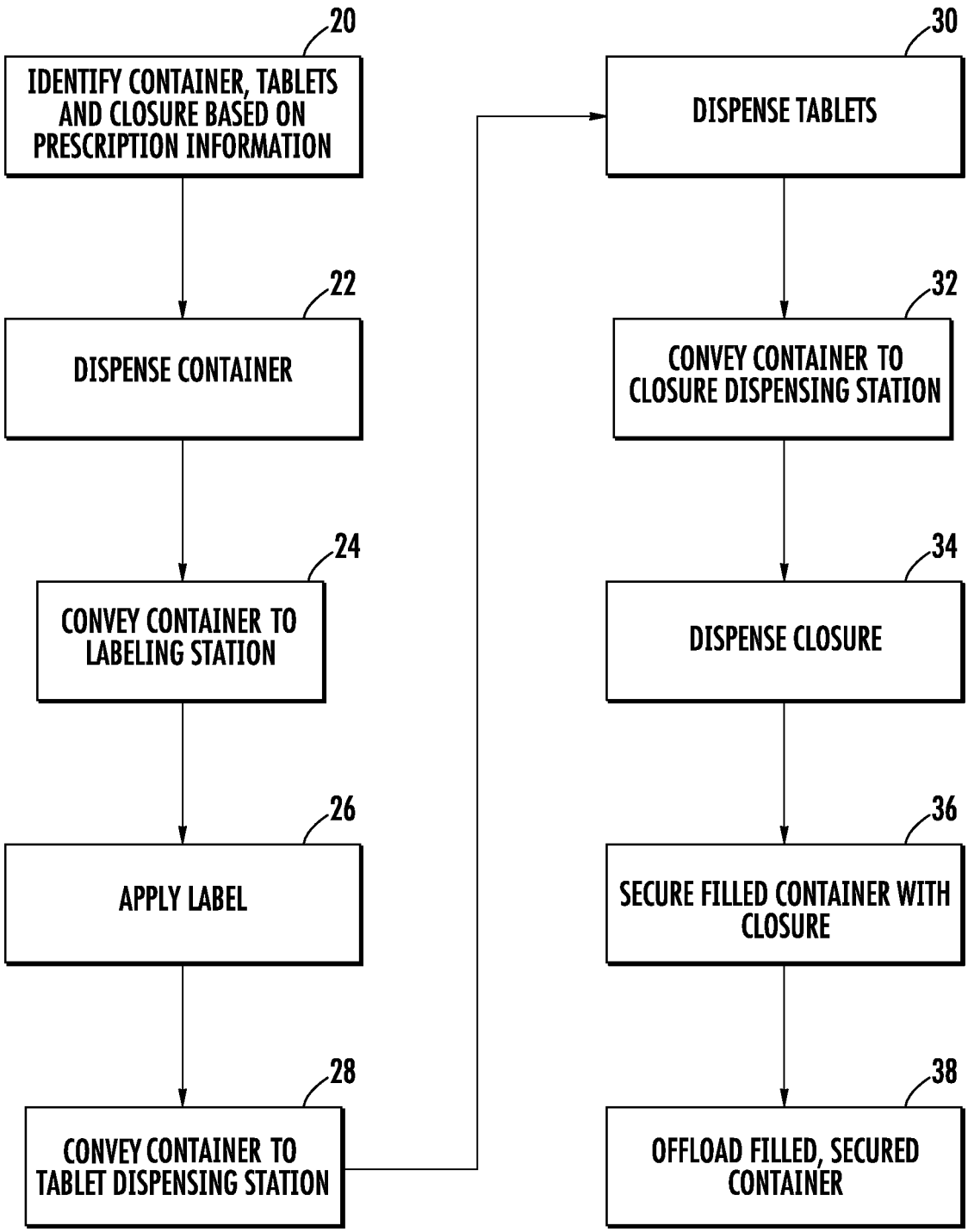
FIG. 1 is a flow chart illustrating an embodiment of a method according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Also, as used herein, the terms "cap" and "closure" are used interchangeably to refer to a component that caps or closes a pharmaceutical vial.

Well-known functions or constructions may not be described in detail for brevity and/or clarity.

As described above, the invention relates generally to a system and process for dispensing pharmaceuticals. An exemplary process is described generally with reference to FIG. 1. The process begins with the identification of the proper container, tablets or capsules and closure to be dispensed based on a patient's prescription information (Box 20). A container of the proper size is dispensed at a container dispensing station (Box 22), then moved to a labeling station (Box 24). The labeling station applies a label (Box 26), after which the container is transferred to a tablet dispensing station (Box 28), from which the designated tablets are dispensed in the designated amount into the container (Box 30). The filled container is then moved to a closure dispensing station (Box 32), where a closure of the proper size has been dispensed (Box 34). The filled container is secured with a closure (Box 36), then transported to an offload station and offloaded (Box 38).

Figure 2:
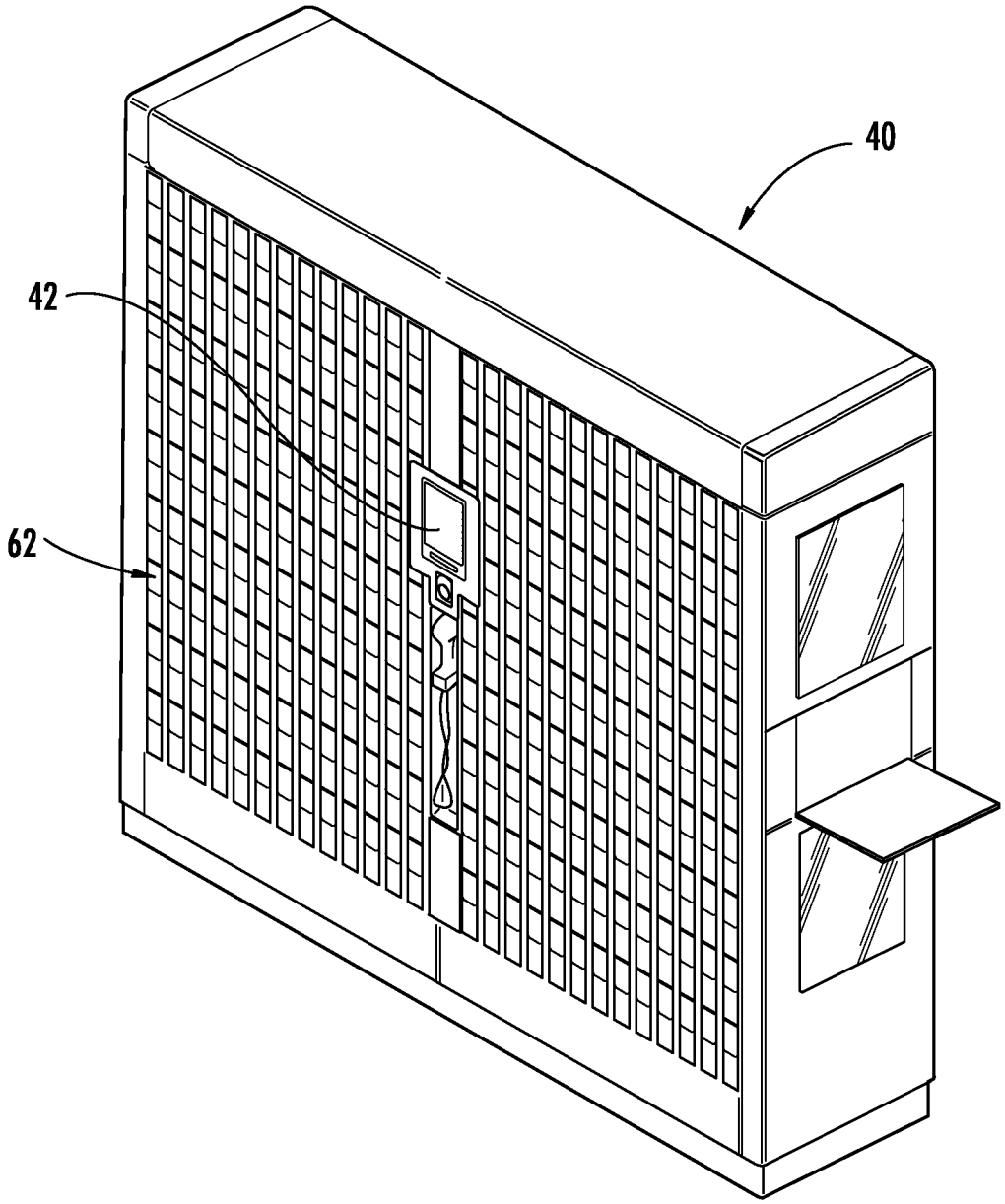
FIG. 2 is a perspective view of a pharmaceutical tablet dispensing system according to the present invention.
Figure 3:
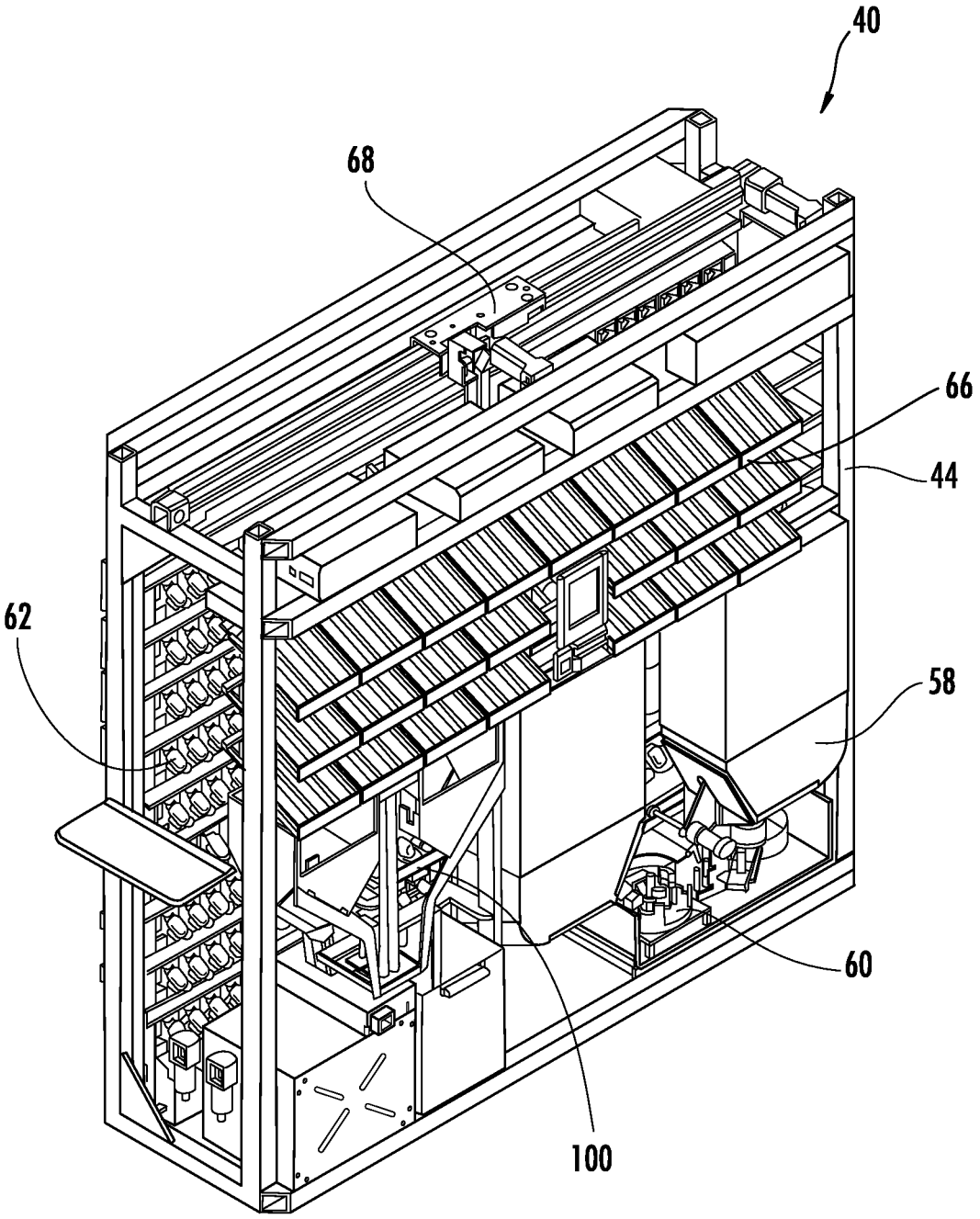
FIG. 3 is a cutaway reverse perspective view of the system of FIG. 2 illustrating the support frame, the container dispensing station, the carrier, and the closure dispensing station.

A system that can carry out this process is illustrated in FIGS. 2 and 3 and designated broadly therein at 40. The system 40 includes a support frame 44 for the mounting of its various components. The system 40 generally includes as operative stations a controller (represented herein by a graphics user interface monitor 42), a container dispensing station 58, a labeling station 60, a tablet dispensing station 62, a closure station 100, and an offloading station 66. In the illustrated embodiment, containers, tablets and closures are moved between these stations with a single carrier 68; however, in some embodiments additional carriers may be employed. With the exception of the closure station 100, which is described in detail below, each of the other operative stations and the conveying devices is described in detail in U.S. Pat. No. 6,971,541 to Williams et al.; U.S. Pat. No. 8,261,936 to Dumond et al.; and U.S. Pat. No. 8,016,095 to Daniels et al., and U.S. Patent Application Publication Nos. 2008/0110555 to Bouchelle et al.; and 2008/0283179 to Sink, the disclosure of each of which is hereby incorporated herein in its entirety.

Figure 4:
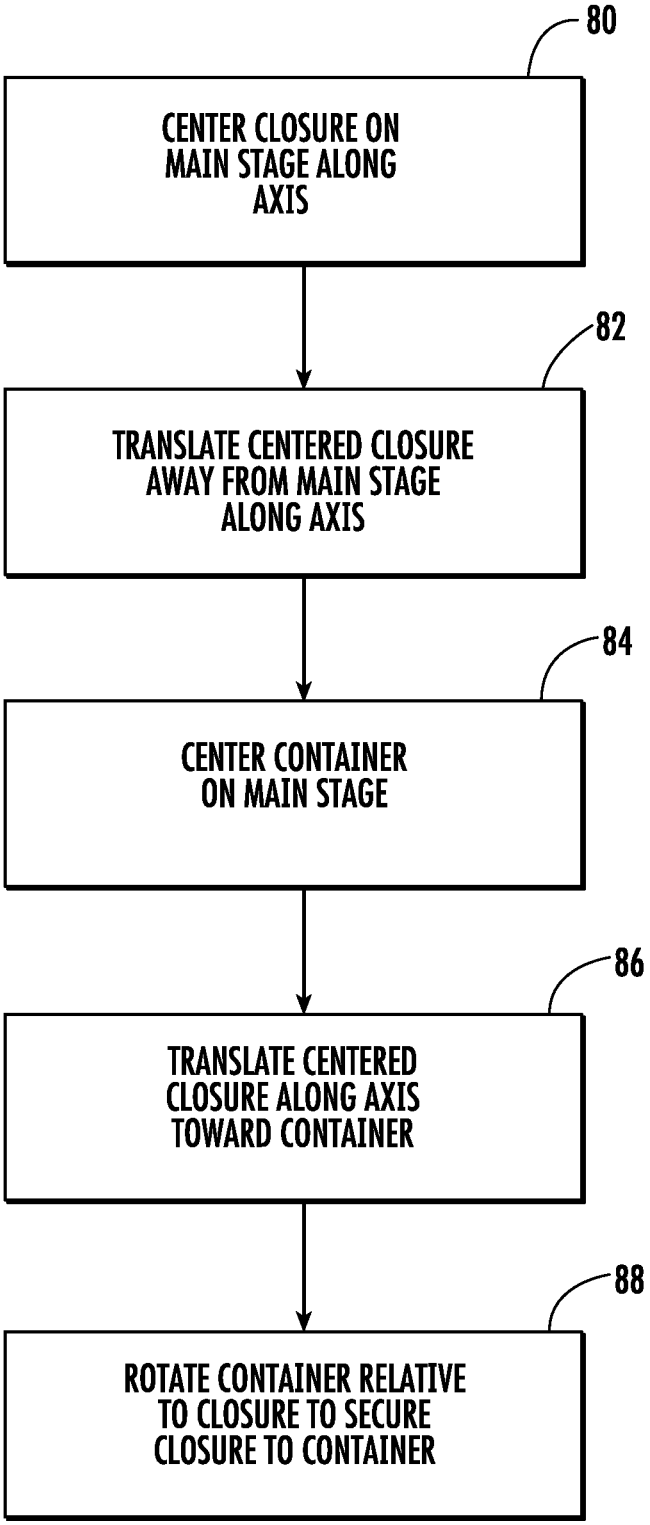
FIG. 4 is a flow chart illustrating an embodiment of a method of applying a closure to a filled vial according to embodiments of the present invention.

Referring now to FIG. 4, general operations of the closure station 100 are illustrated in the form of a flow chart. According to embodiments of the present invention, a closure is centered along an axis at a first position (Block 80), then translated along that axis to a second position (Block 82). A filled vial or other container is then centered along the axis (Block 84). The centered closure is translated along the axis to a third position adjacent the container (Block 86), and the container is rotated relative to the closure about the axis to secure the closure to the container (Block 88). This method can assure that the closure and container are both centered about the same axis, which in turn can improve the reliability of the process of securing the closure onto the container.

Figure 5:
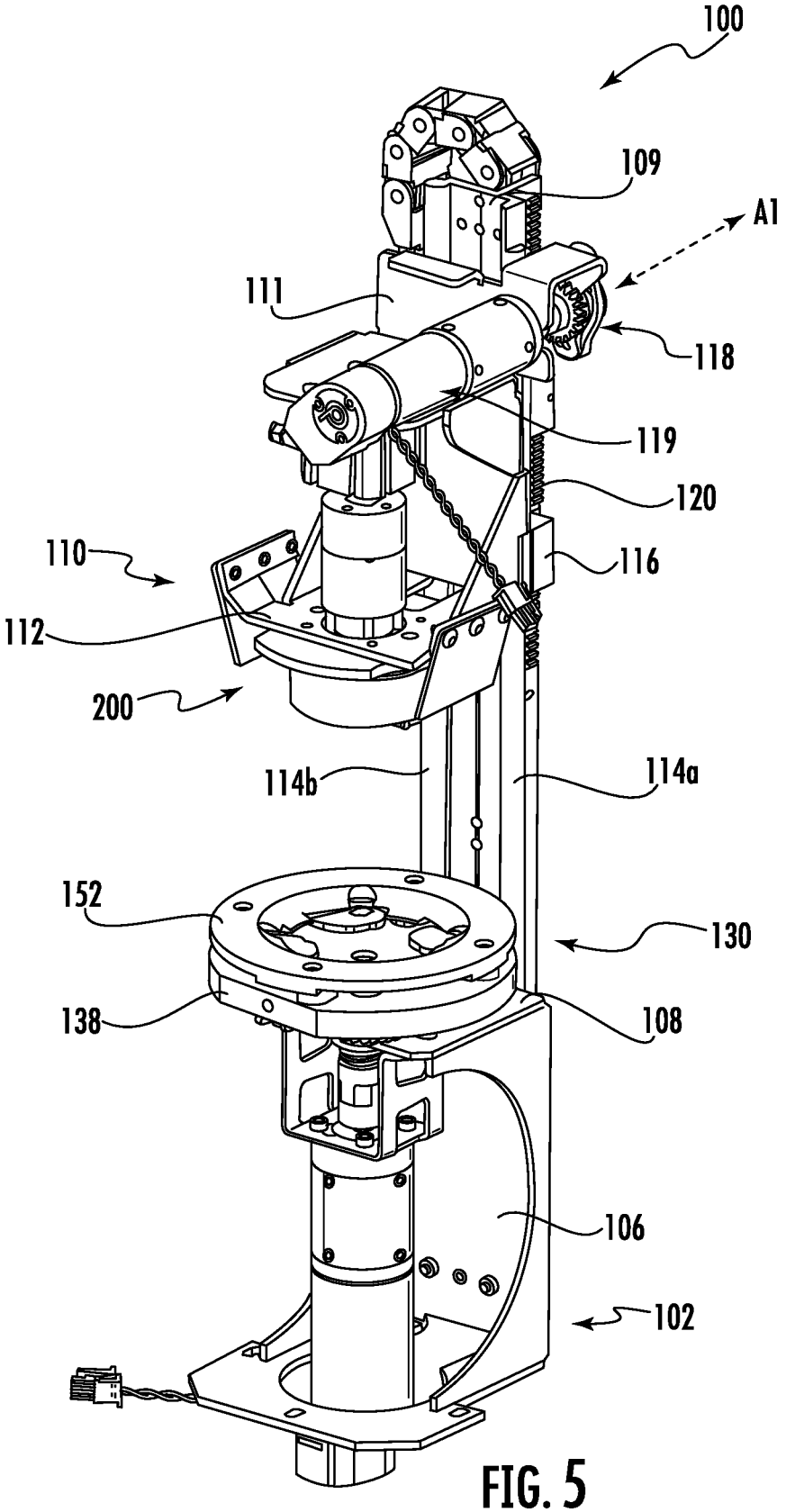
FIG. 5 is a perspective view of a closure station for the system of FIG. 2 shown in a raised position.
Figure 6:
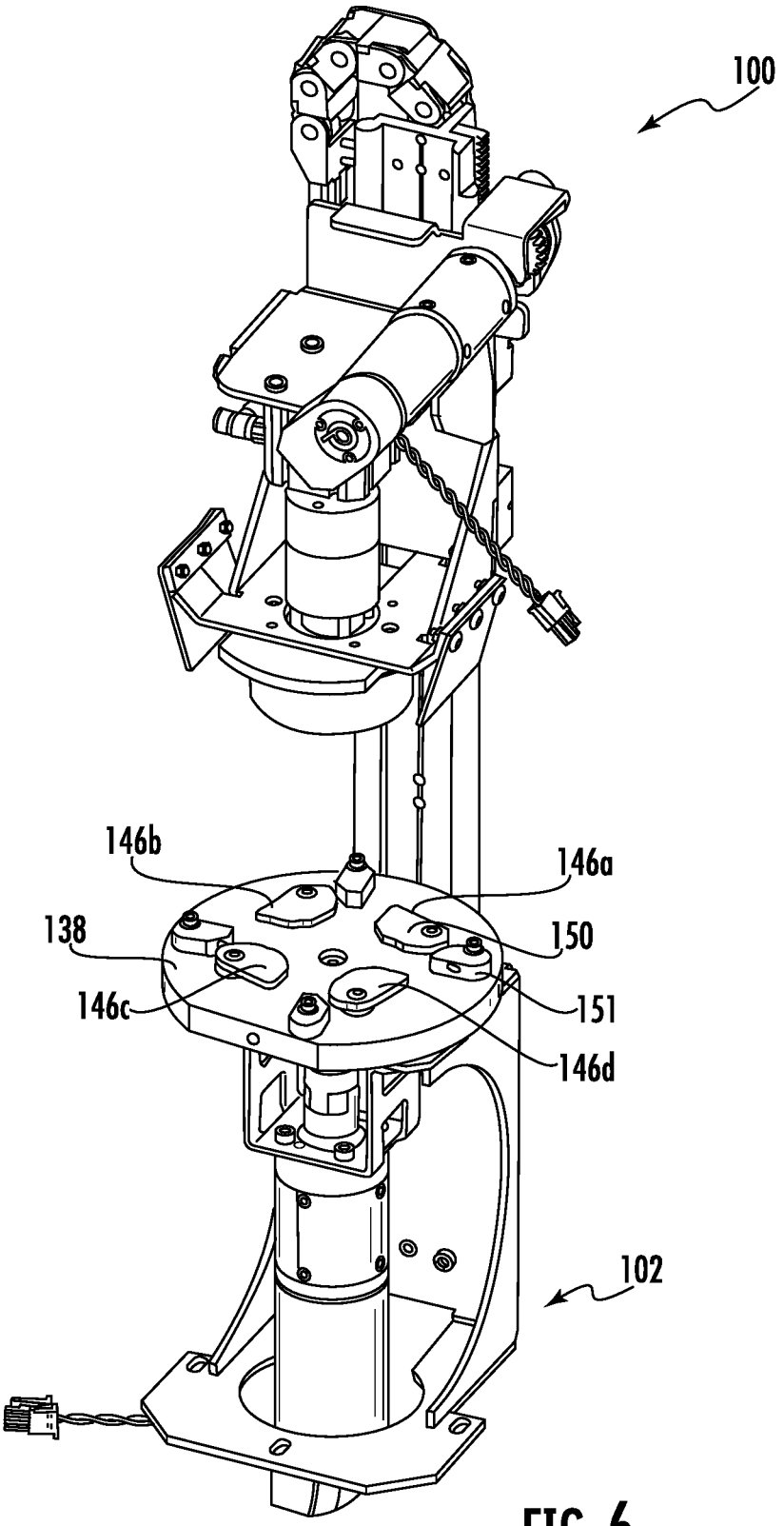
FIG. 6 is a perspective view of the closure station of FIG. 5 in a raised position with the upper stage removed.

Referring now to FIGS. 5 and 6, the basic structure of the closure station 100 (which is capable of carrying out the method described in FIG. 4) is illustrated therein. The structure and function of the closure station 100 are described in considerable detail in U.S. Pat. Nos. 7,581,373, 7,596,932, 7,770,358, and 8,413,410, the disclosure of each of which is hereby incorporated herein in its entirety, and will only be described generally herein. The closure station includes a frame 102, an elevator or elevator assembly 110 attached to the frame, and a centering assembly 130 that is also mounted to the frame. The elevator 110 can be raised and lowered relative to the centering assembly 130 and includes a cap holder assembly 200 through which suction can be applied. The centering assembly 130 has a circular main stage 138 and an annular upper stage 152 that are rotatable relative to the frame 102. Four cams or clamps 146*a*, 146*b*, 146*c*, 146*d* are rotatably mounted to the main stage 138 at the same radial distance from the center of the main stage 138.

With continued reference to FIGS. 5 and 6, the elevator 110 is mounted to the rear surface of a support 106. The elevator 110 has a base member 111 that extends vertically and generally parallel to an elevator mounting member 109. A floor 112 merges with the lower end of the base member 111 and extends forwardly over the upper platform 108 of the frame 102. The base member 111 and the floor 112 may collectively be referred to herein as the carrier bracket. Rails 114*a*, 114*b* are formed in the outer edges of the elevator mounting member 109 and extend for virtually its entire height. The rails 114*a*, 114*b* engage bearings 116 that are mounted to the rear surface of the base member 111. A drive pinion 118 is rotatably mounted on the rear side of the base member 111. A drive motor 119 is mounted on the front side of the base member 111 opposite the drive pinion 118 to rotate the drive pinion 118 about the axis A1. A toothed rack 120 with outwardly-facing teeth extends vertically on the back side of the elevator mounting member 109.

Figure 7:
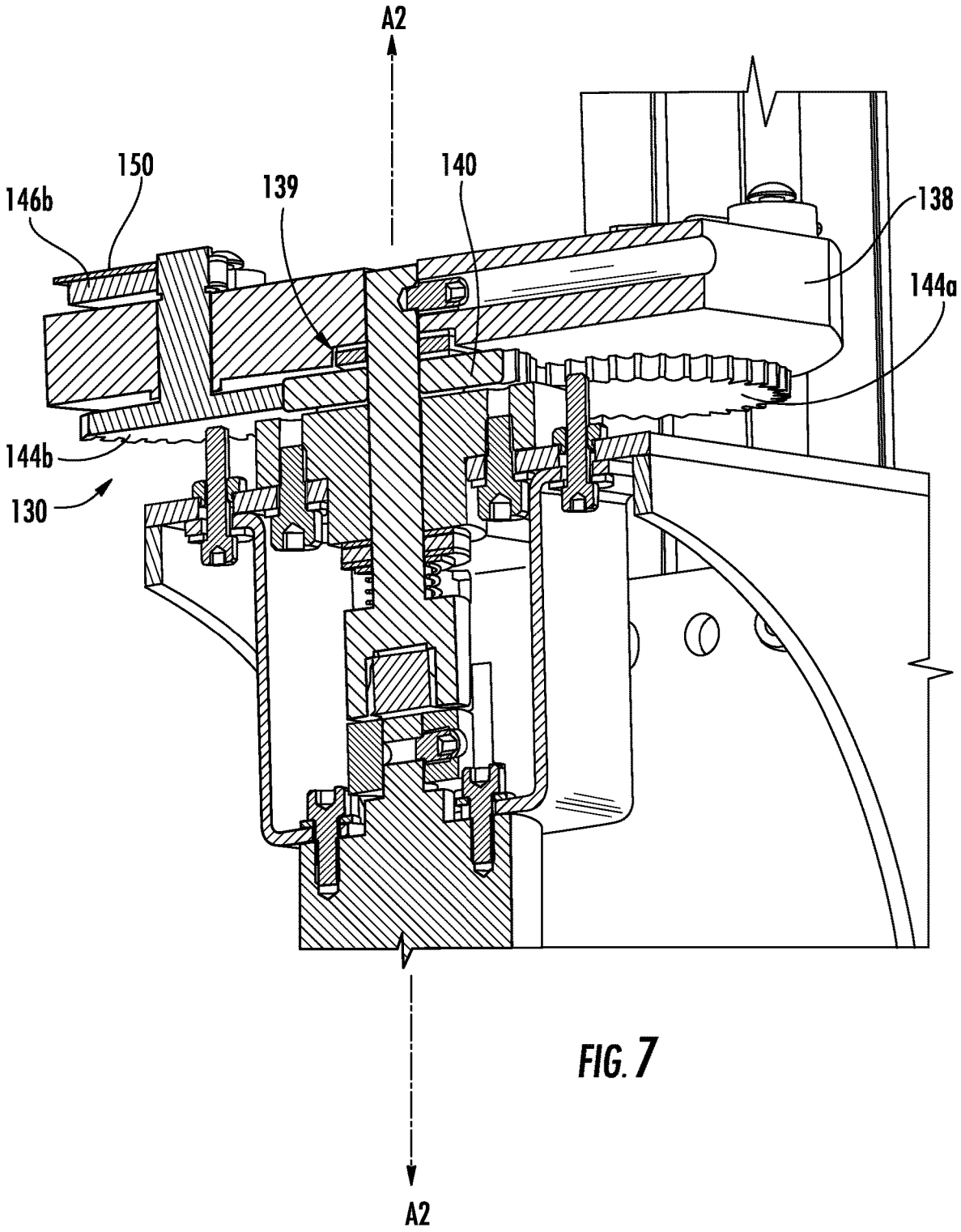
FIG. 7 is an enlarged bottom perspective section view of the main stage and drive assembly of the closure station of FIG. 5.
Figure 8:
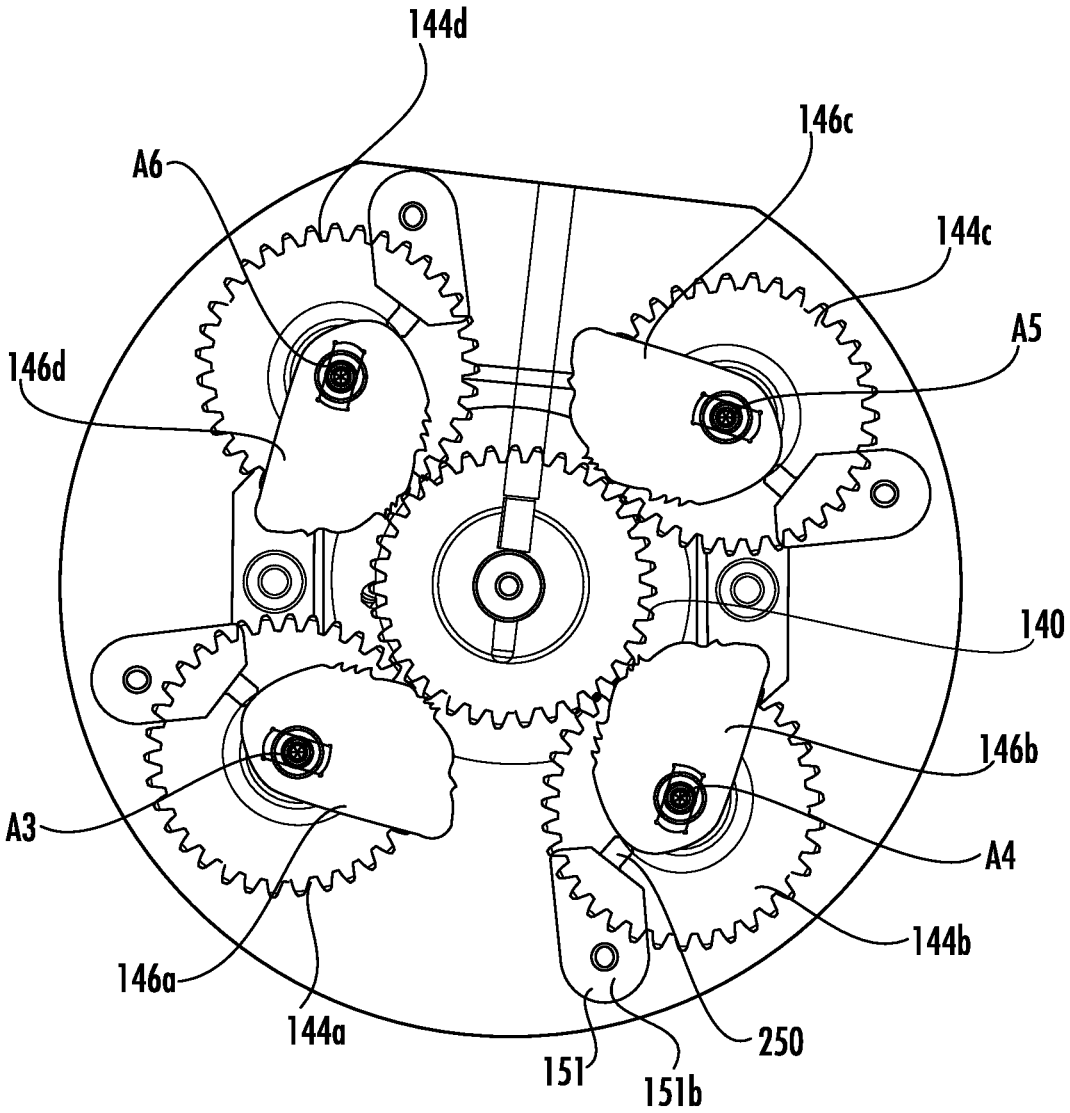
FIG. 8 is a top view of the main stage of the closure station of FIG. 5 with the upper stage removed.

Referring now to FIGS. 7 and 8, each of the clamps 146*a*, 146*b*, 146*c*, 146*d* is fixed to a respective clamp gear 144*a*, 144*b*, 144*c*, 146*d* that in turn engages a central sun gear 140. The sun gear 140 is mounted relative to the main stage 138 such that an intervening clutch mechanism 139 permits or prevents rotation of the sun gear 140 relative to the main stage 138, with the result that under certain pressure conditions the sun gear 140 remains stationary as the main stage 138 rotates, and under other pressure conditions the sun gear 140 rotates with the main stage 138. The structure and function of the clutch mechanism is described in detail in U.S. Pat. No. 7,581,373, supra, and need not be described herein. Rotation of the main stage 138 causes the clamps 146*a*, 146*b*, 146*c*, 146*d* to rotate about their respective axes A3, A4, A5, A6 (see FIG. 8), with their direction of rotation dependent on the rotative direction of the main stage 138 and whether or not the sun gear 140 is engaged via the clutch mechanism 139 for rotation with the main stage 138 or is disengaged and remains stationary.

Figure 9:
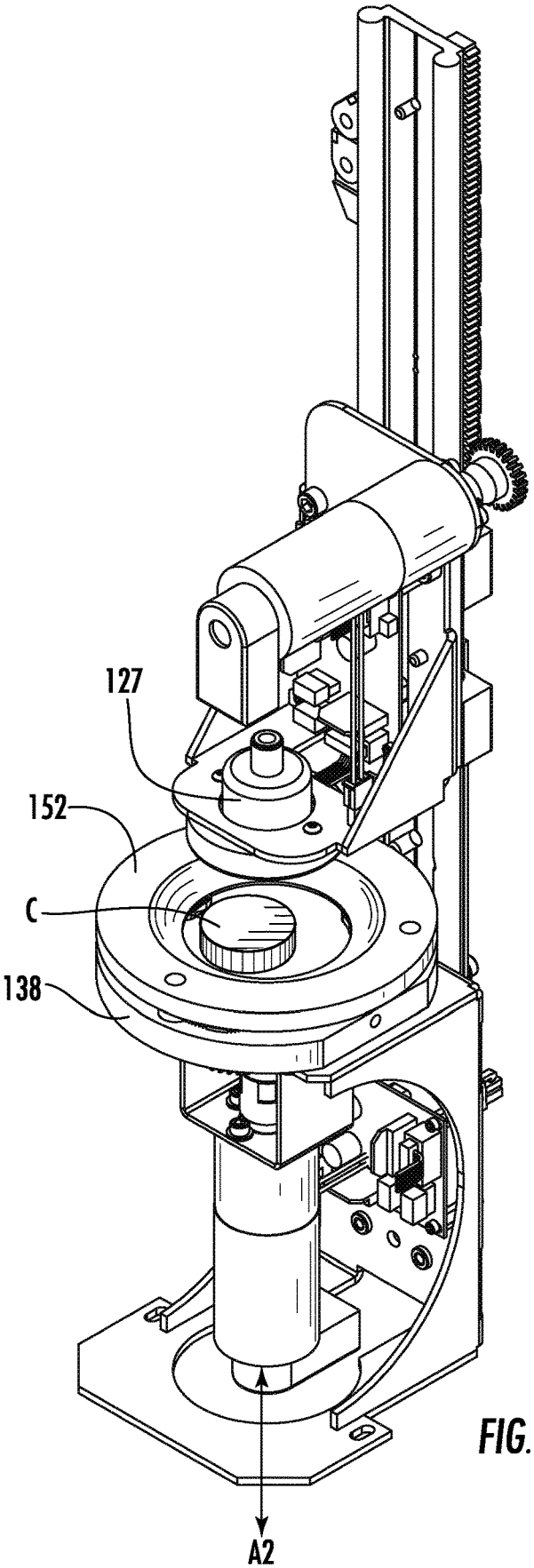
FIG. 9 is a perspective view of the closure station of FIG. 5 showing the reception of a closure, with the elevator in an intermediate position.
Figure 10:
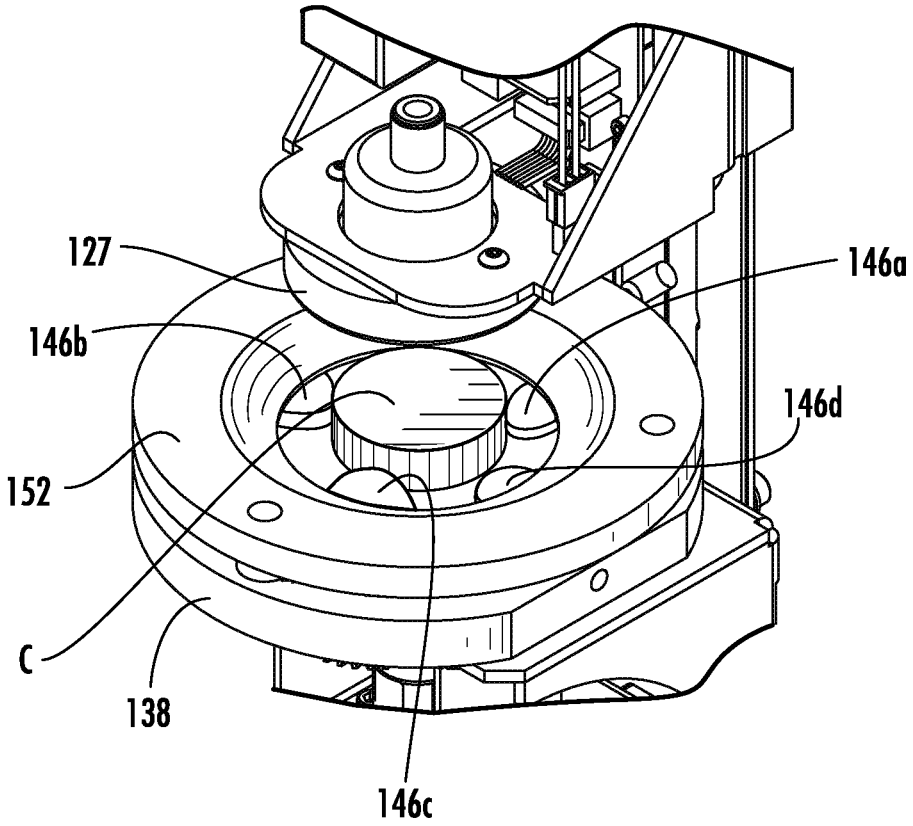
FIG. 10 is an enlarged perspective view of the closure station of FIG. 5 showing the clamping of a closure.
Figure 11:
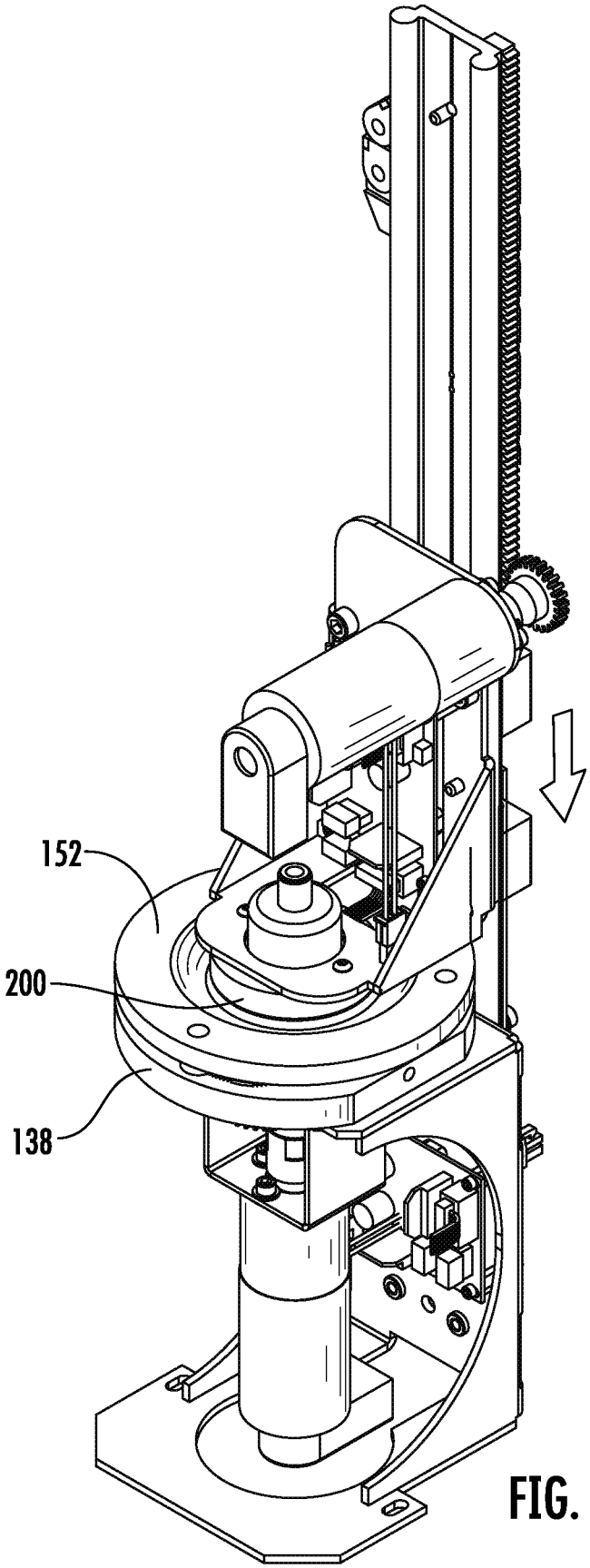
FIG. 11 is a perspective view of the closure station of FIG. 5 showing the elevator capturing the closure.
Figure 12:
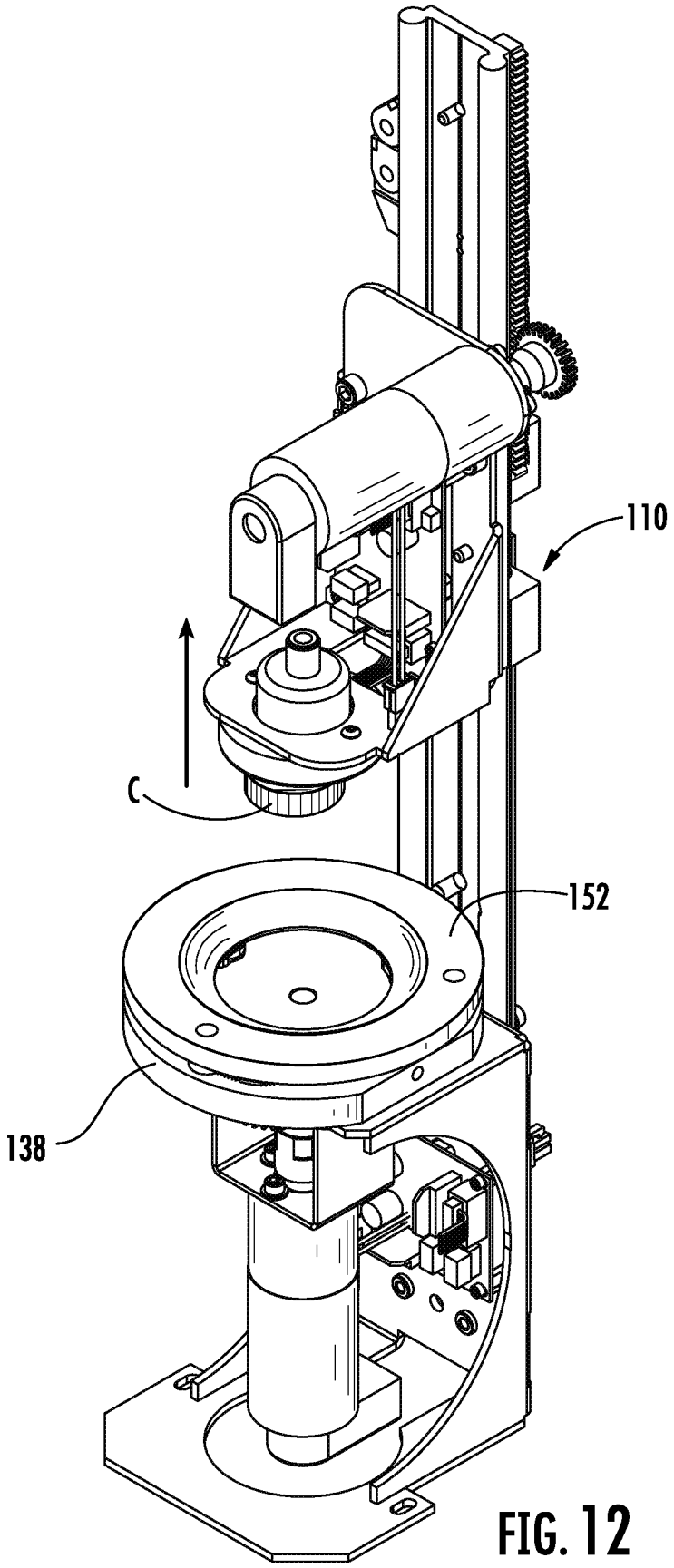
FIG. 12 is a perspective view of the closure station of FIG. 5 showing the elevator and closure in a raised position.
Figure 13:
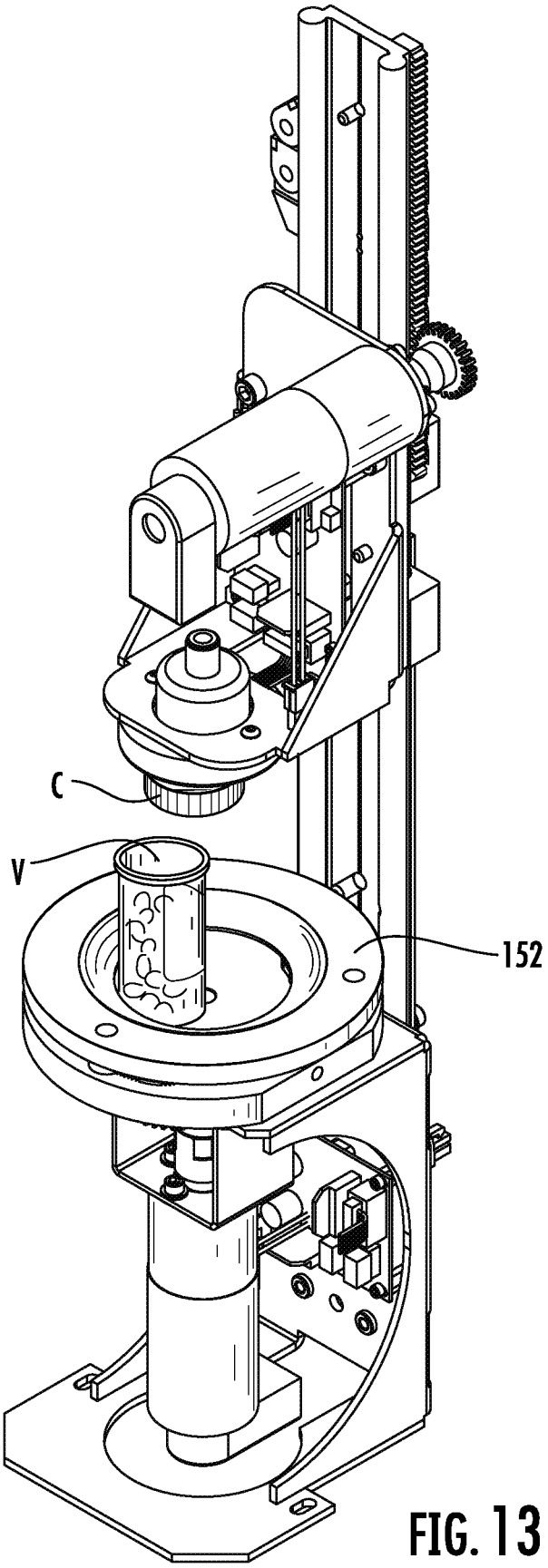
FIG. 13 is a perspective view of the closure station of FIG. 5 showing the receipt of a filled vial on the main stage.
Figure 14:
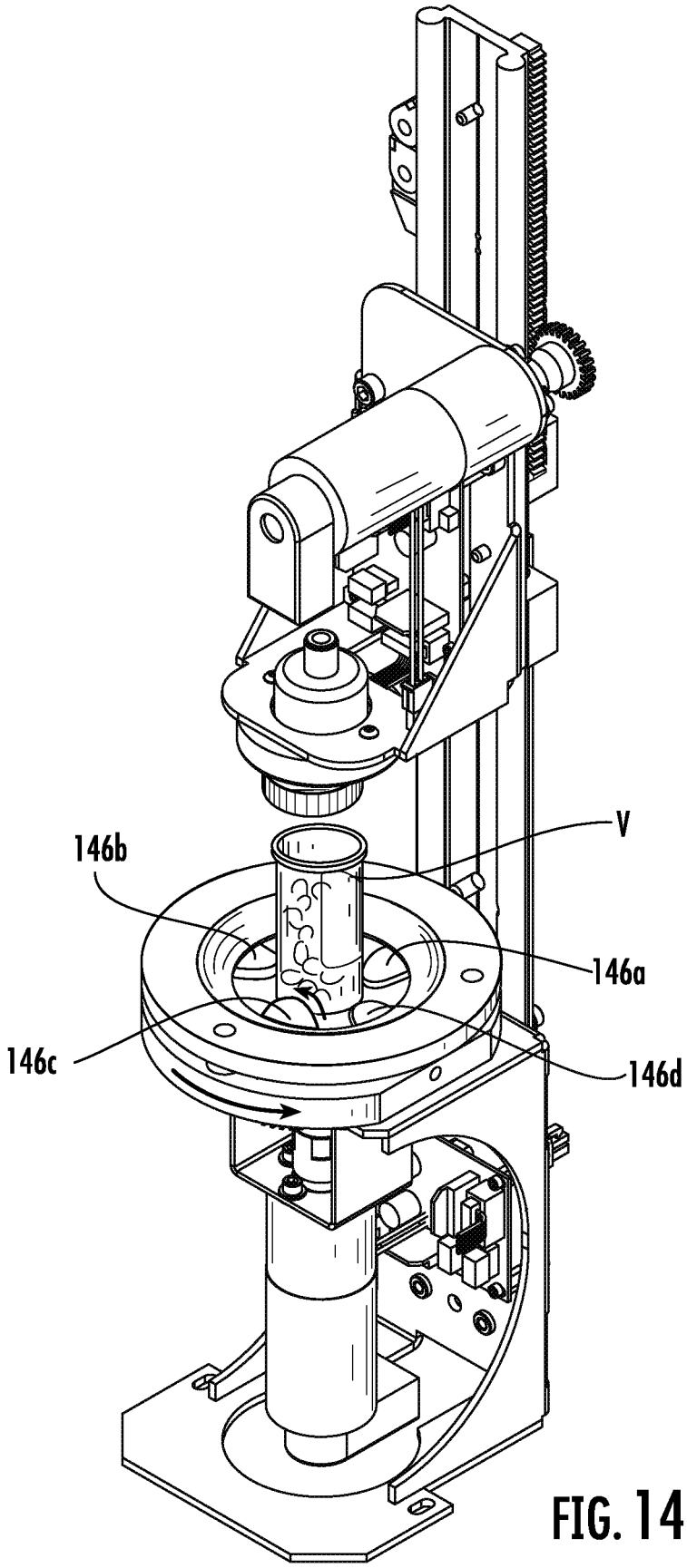
FIG. 14 is a perspective view of the closure station of FIG. 5 showing the operating of the clamps to center the filled vial.
Figure 15:
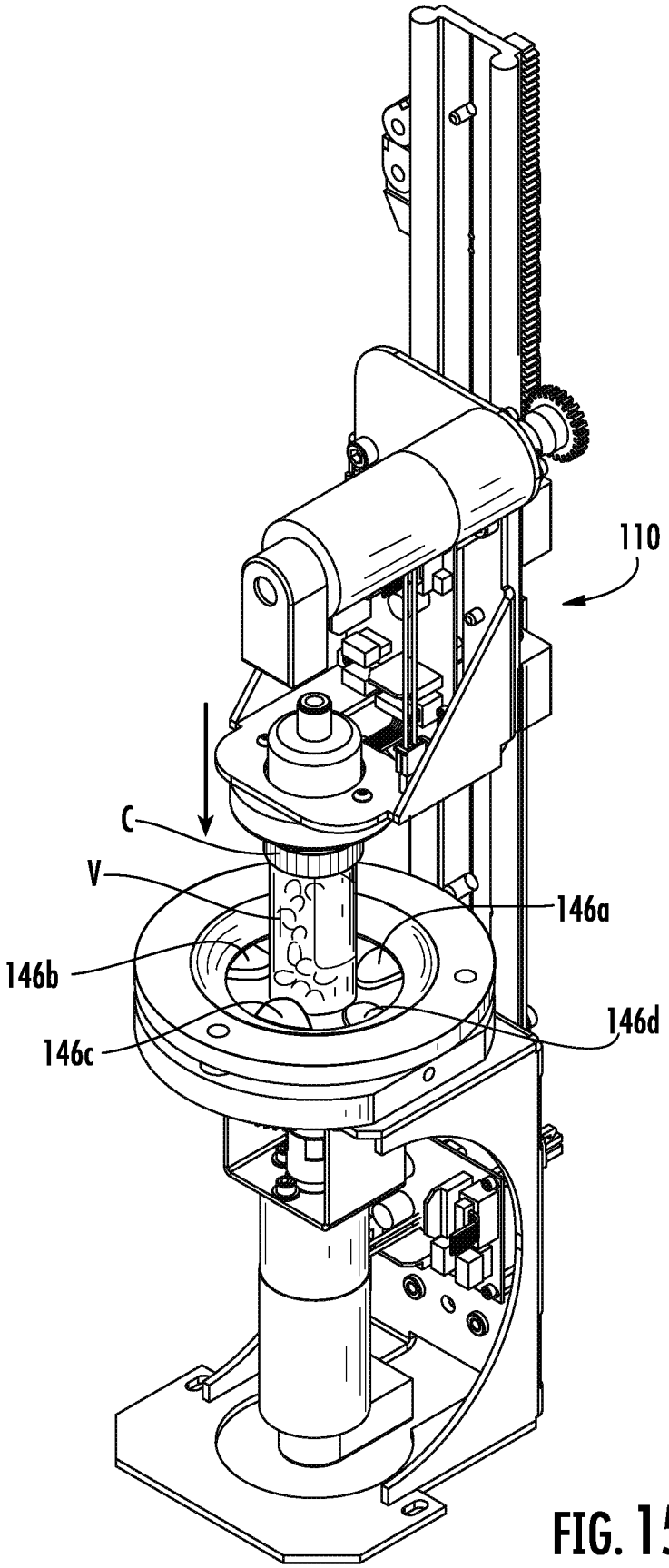
FIG. 15 is a perspective view of the closure station of FIG. 5 showing the lowering of the elevator to deposit the closure on the filled vial.
Figure 16:
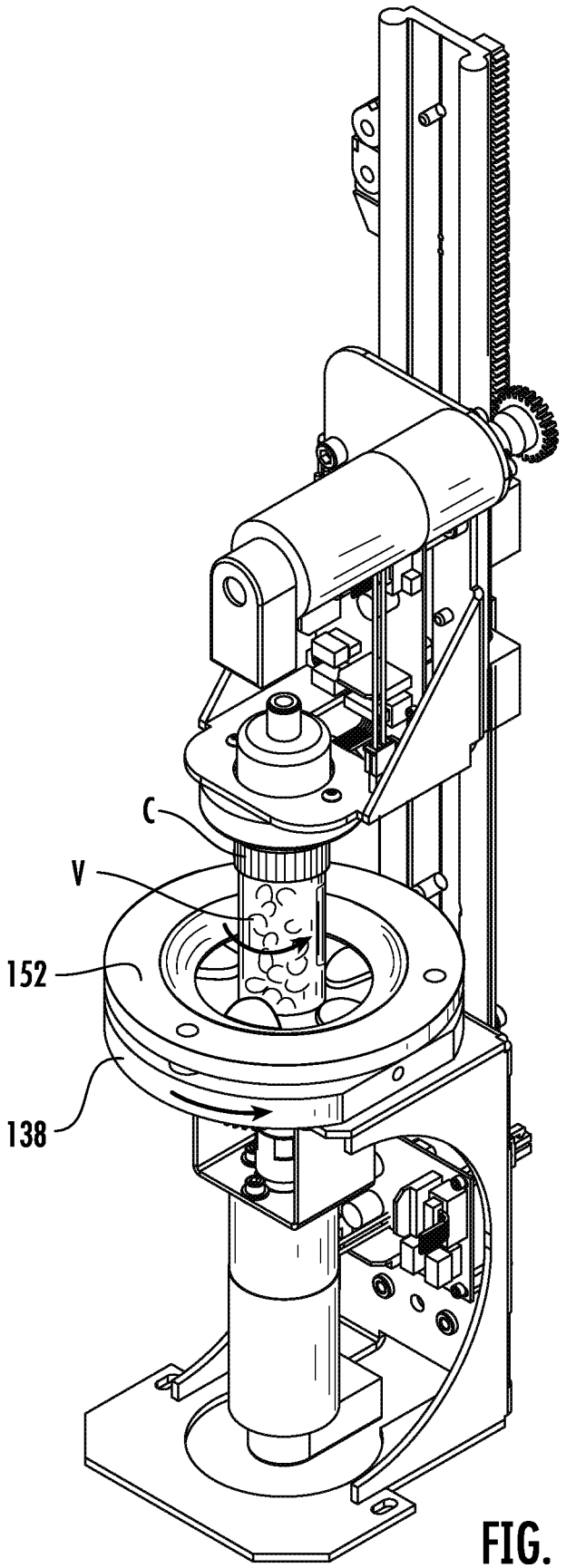
FIG. 16 is a perspective view of the closure station of FIG. 5 showing the rotation of the main stage to secure the closure to the filled vial.
Figure 17:
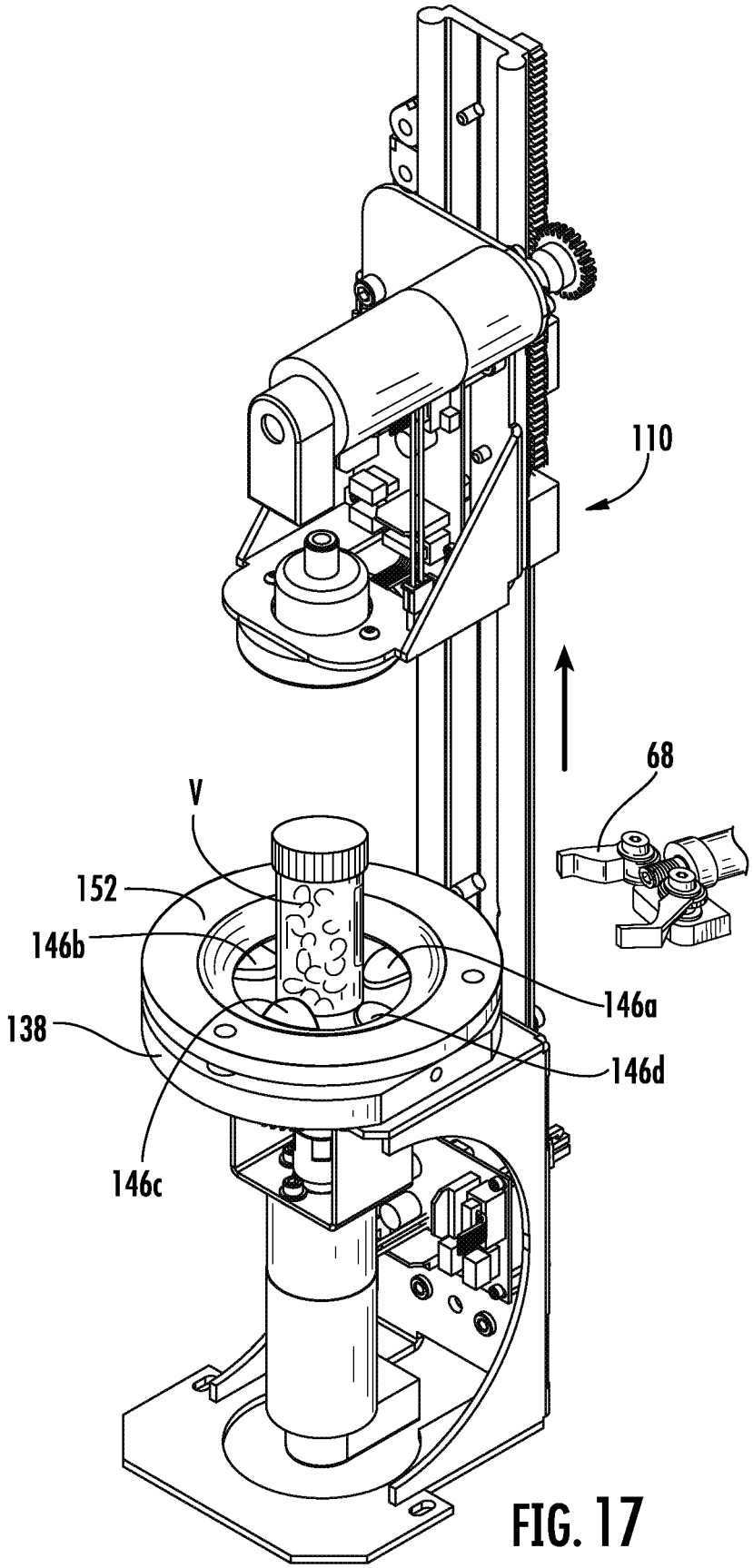
FIG. 17 is a perspective view of the closure station of FIG. 5 showing the elevator in the raised position and the dispensing carrier retrieving the filled, capped vial from the closure station.

As can be seen from FIGS. 9-17, a cap C is deposited on the main stage 138 within the aperture of the upper stage 152 (FIG. 9). The main stage 138 rotates about an axis A2 (counterclockwise from the vantage point of FIG. 9) but the clutch mechanism 139 does not engage the sun gear 140, which remains stationary. Rotation of the main stage 138 rotates the clamps 146*a*, 146*b*, 146*c*, 146*d* counterclockwise; the rotation of the clamps 146*a*, 146*b*, 146*c* forces the cap C into the center of the main stage 138 (FIG. 10). The main stage 138 rotates clockwise to retract the clamps 146*a*, 146*b*, 146*c*, 146*d*. The elevator 110 then descends (FIG. 11) and, via suction applied through the cap holder assembly 200, lifts the centered cap C from the main stage 138 (FIG. 12). The carrier 68 then deposits a filled vial onto the main stage 138 (FIG. 13). The main stage 138 rotates counterclockwise, which again rotates the clamps 146*a*, 146*b*, 146*c*, 146*d* counterclockwise. Contact between the clamps 146*a*, 146*b*, 146*c*, 146*d* and the vial V centers the vial V (FIG. 14). The elevator 110 lowers the cap C onto the open upper end of the vial V (FIG. 15). The main stage 138 then continues to rotate counterclockwise and the clutch mechanism 139 associated with the sun gear 140 engages, such that the sun gear 140 also rotates and the clamps 146*a*, 146*b*, 146*c*, 146*d* remain in their angular positions gripping the vial V (FIG. 16). Rotation of the main stage 138 rotates the vial V relative to the cap C, which rotation screws the cap C onto the vial V. Once the cap C is secured, the elevator 110 relaxes its suction and rises away from the main stage 138 (FIG. 17). The main stage 138 then rotates clockwise to release the clamps 146*a*, 146*b*, 146*c*, 146*d* and the carrier 68 returns to grasp the vial V and convey it to the offloading station 66 or the like. This is described and shown in greater detail in U.S. Pat. No. 8,413,410, supra.

In the capping station 100 described in U.S. Pat. No. 7,581,373, supra, the vial/cap clamps 146*a*, 146*b*, 146*c* include shields 150 on their upper surfaces in order to prevent snagging of the caps C during centering (the shields 150 can be seen in FIGS. 7 and 8). A cap C is particularly susceptible to snagging when it is deposited between two clamps, and in the course of rotating to push the cap C to a centered position, the teeth of two clamps 146*b*, 146*c* engage the cap C at the same time. This arrangement can cause the cap to "lock" between the clamps 146*b*, 146*c* rather than sliding toward the center of the main stage 138. The shields 150 are included to protect the cap C from exposure to the teeth of the clamps 146*a*, 146*b*, 146*c*, 146*d* until the cap C reaches a generally centered position in which snagging is less likely. Although the shields 150 are generally successful in performing this function, each shield 150 represents an additional component, so for the purposes of cost and component number reduction, it may be desirable to provide a design for the clamps that eliminates the need for the shields 150.

In the closure station 100 described in U.S. Pat. No. 8,413,410, supra, three cams or clamps 146*a*, 146*b*, 146*c* were used. It has been determined that four cams or clamps 146*a*, 146*b*, 146*c*, 146*d* may be preferable for certain types of vials. This is described in more detail below.

Figure 18:
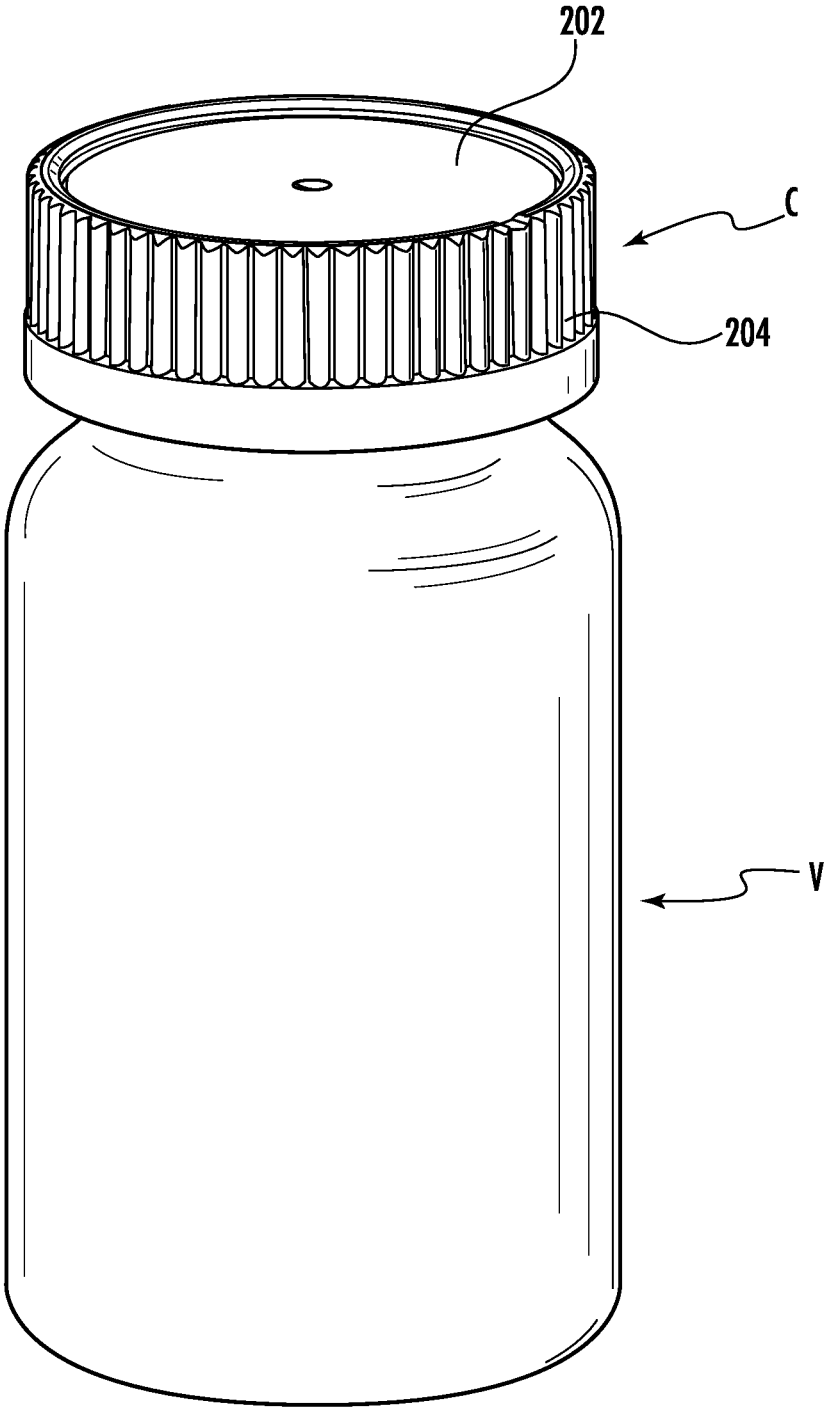
FIG. 18 is a top perspective view of a vial and cap with the cap configured to be in a child-resistant orientation and a non-child-resistant orientation.
Figure 19A:
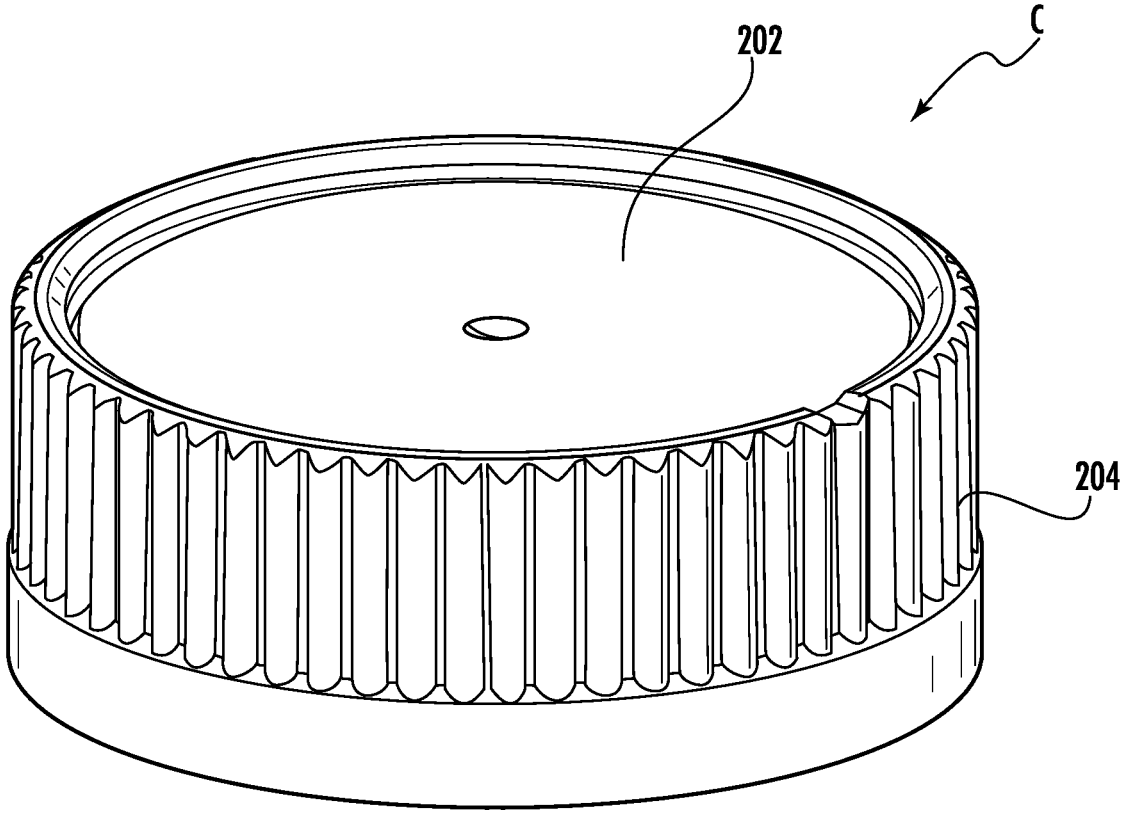
FIG. 19A is a top perspective view of the cap of FIG. 18 in the child-resistant orientation.
Figure 19B:
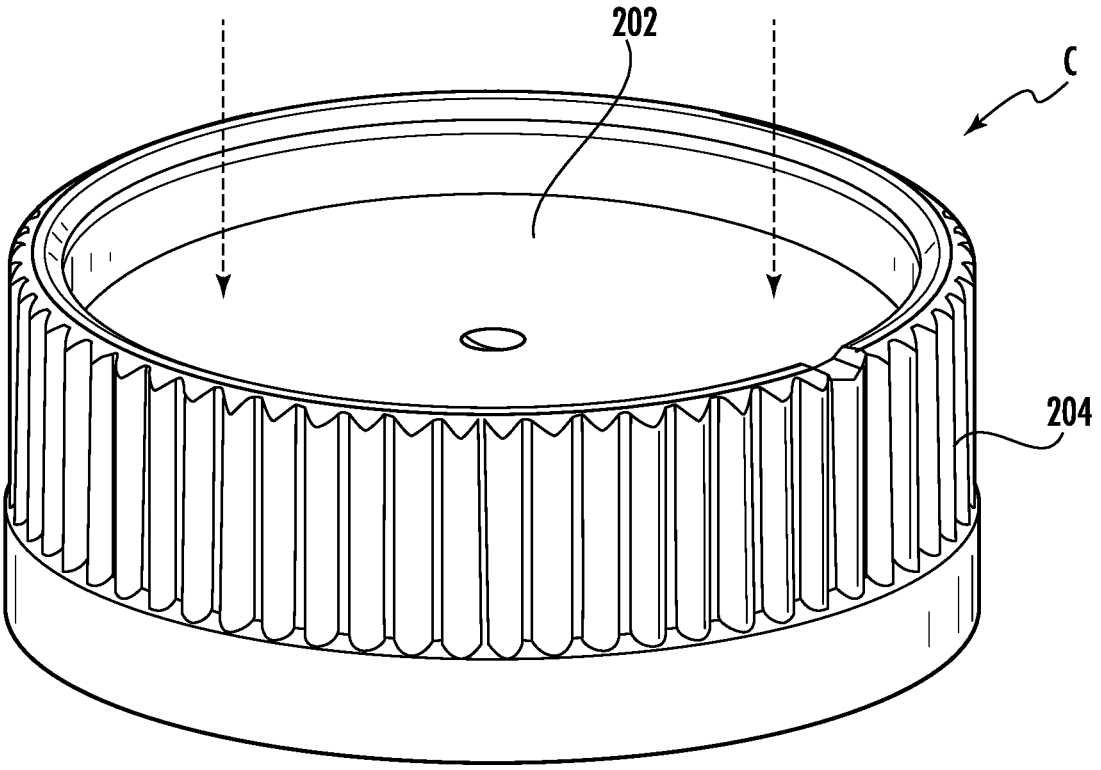
FIG. 19B is a top perspective view of the cap of FIG. 18 in the non-child-resistant orientation.

A prescription vial V and cap C are illustrated in FIGS. 18 and 19. The cap C includes a center portion 202 and an outer sidewall portion or circumferential edge 204. The cap C is configured to be to be manipulated between a child-resistant orientation or state (FIG. 19A) and a non-child-resistant orientation or state (FIG. 19B). Specifically, the center portion 202 may be pressed downward relative to the outer portion 204 (as indicated by the arrows in FIG. 19B) to place the cap C in the non-child-resistant orientation. There may be audible and/or tactile feedback such as a "snap" or "click" when the cap C is successfully manipulated from the child-resistant orientation to the non-child-resistant orientation. An example of this type of vial and cap is the ProMaxx® series available from Altium Healthcare.

Certain customers may want their prescriptions to be provided in a vial with the cap in the non-child-resistant orientation. The capping station 100 includes features that allow the prescription to be provided with the cap in the non-child-resistant orientation.

Figure 20:
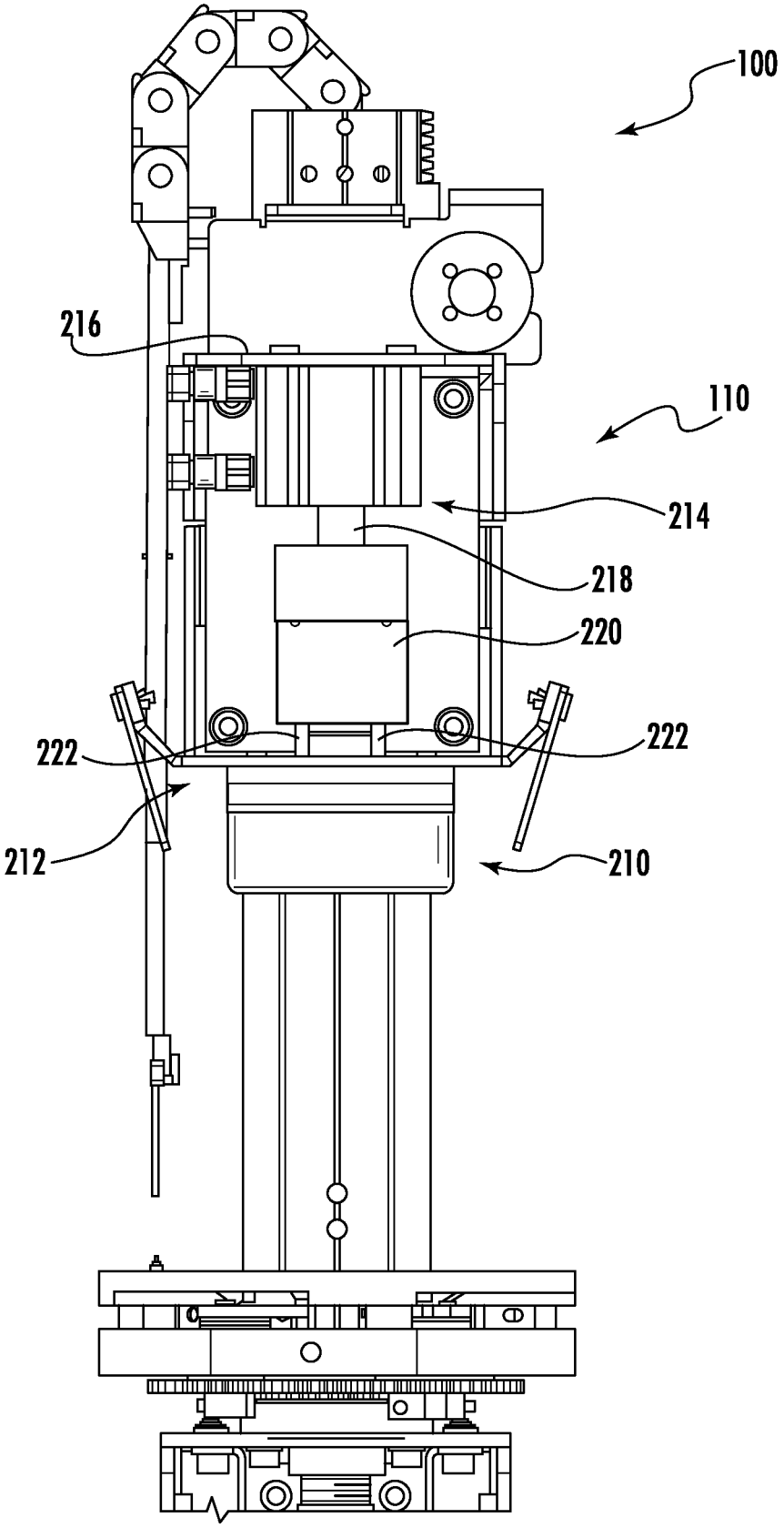
FIG. 20 is an enlarged front view of a closure station including an actuator configured to drive core pins through a cap carrier.
Figure 21:
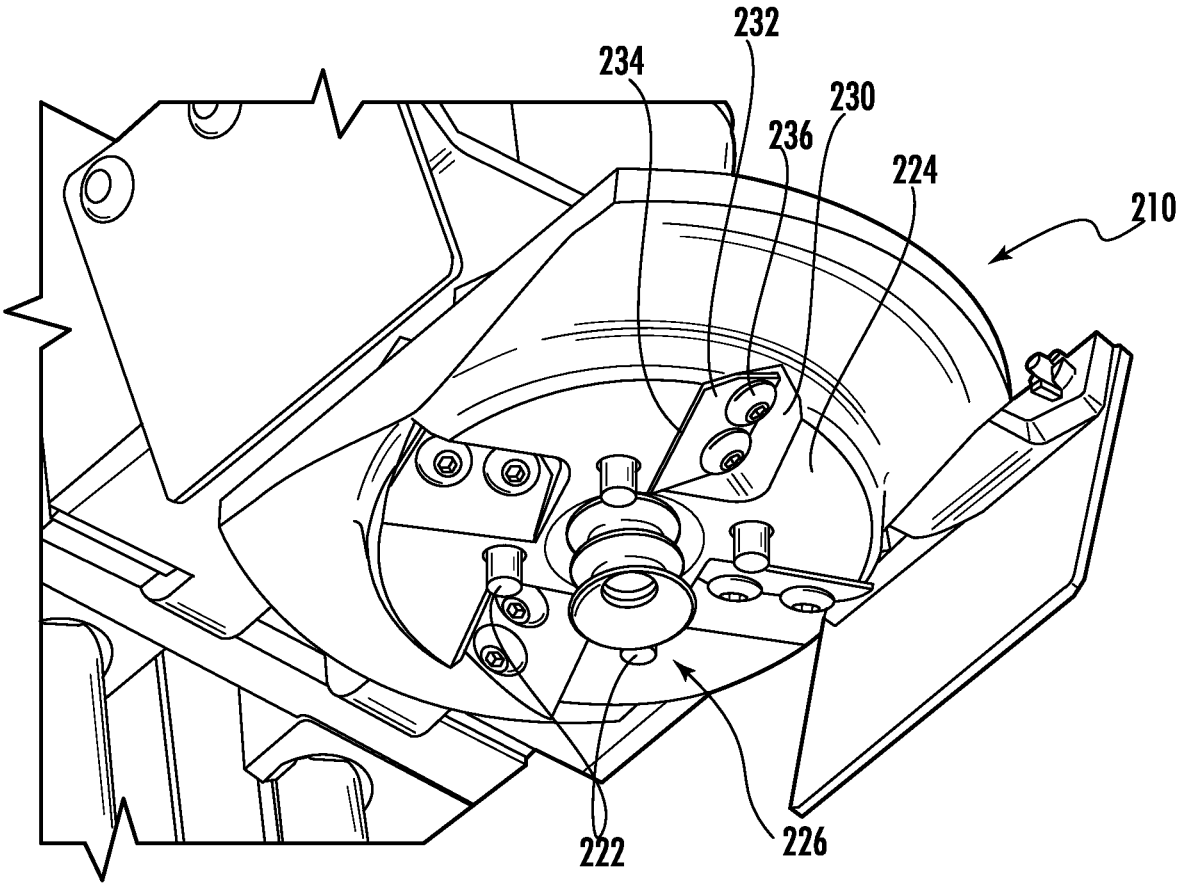
FIG. 21 is a fragmentary bottom perspective view of the carrier and core pins of FIG. 20 according to some embodiments.

Referring to FIGS. 20 and 21, the elevator or elevator assembly 110 includes a carrier 210 connected to a carrier bracket 212. The carrier bracket 212 may be connected to the elevator mounting member 109 (FIG. 5). An actuator 214 is connected to an actuator bracket 216. The actuator bracket 216 may be connected to the elevator mounting member 109 (FIG. 5).

The actuator 214 includes a shaft 218 and a ram 220. At least one extendable member 222 such as at least one core pin extends through the carrier bracket 212 and through the carrier 210 such that the at least one core pin extends downwardly from a bottom surface 224 of the carrier 210.

There may be a plurality of core pins 222. As illustrated, four core pins 222 extend from the actuator 214, through the carrier bracket 212, and through the carrier 210 such that each core pin 222 extends downwardly from the bottom surface 224 of the carrier 210.

A capturing member 226 such as a suction cup is connected to the carrier 210. A suction source (not shown) selectively applies suction to the suction cup 226. The suction cup 226 is configured to capture and hold a cap as described herein. The pins 222 may be radially spaced apart from the suction cup 226 and may surround the suction cup 226.

The pins 222 are movable between a first or home position and a second or engagement or extended position. The pins 222 are shown in the first position in FIGS. 20 and 21. The actuator 214 may drive the ram 220 downwardly and correspondingly drive the pins 222 downwardly to the second position.

Figure 22C:
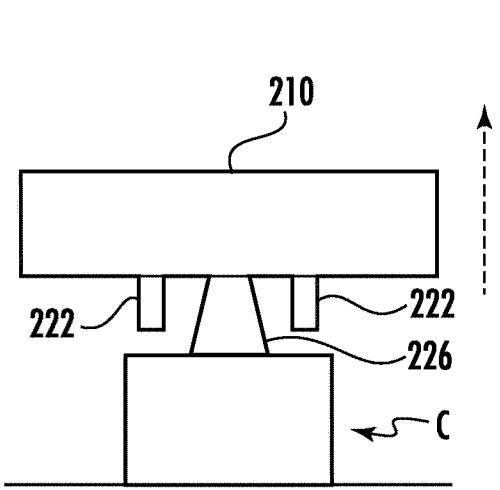
FIGS. 22A-22C schematically illustrate the carrier and core pins of FIG. 21 changing the cap of FIG. 19 from the child-resistant orientation to the non-child-resistant orientation.
Figure 22B:
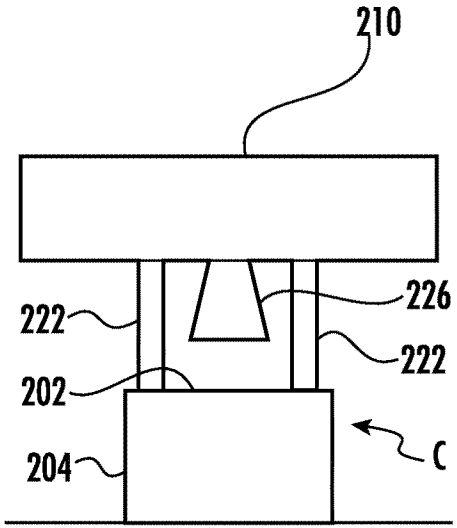
Figure 22A:
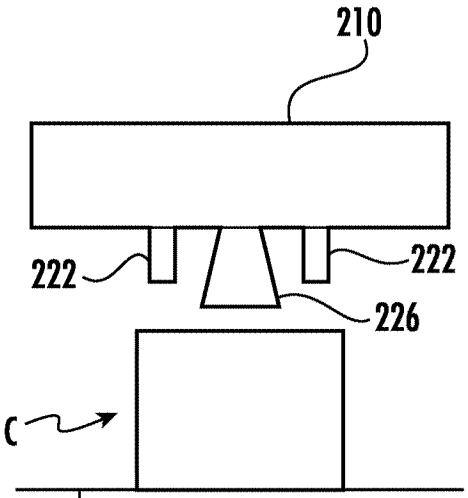

Actuating the pins 222 may allow for the cap C shown in FIGS. 18 and 19 to be placed in the non-child-resistant orientation before the cap C is secured to the vial. For example, with reference to FIG. 22, with the cap C on the stage 138, the elevator 110 may move the carrier 210 to the position shown in FIG. 11 or FIG. 22A. Referring to FIG. 22B, the actuator 214 may cause the pins 222 to move to the second position with sufficient force to "snap" the cap C in the non-child-resistant orientation shown in FIG. 19B. Referring to FIG. 22C, suction may be applied by the suction cup 226 and the carrier 210 may then raise the cap C so that a filled vial may be placed on the stage for capping as described herein.

In the embodiment shown in FIG. 21, four recesses 230 are arranged in the carrier 210 generally circumferentially equidistant about the suction cup 226. A blade 232 with a sharp lower edge 234 is mounted in each of the recesses 230 via screws 236.

In operation, the carrier 210 lowers to pick up a centered cap from the centering assembly 130 in the same manner as described above, and descends with the cap in the same manner after a vial is centered by the centering assembly 130 (FIG. 15). However, once the cap C engages the vial and the centering assembly 130 begins to rotate the vial, the lower edges 234 of the blades 232 can dig into the perimeter edge of the cap to provide additional gripping torque and help to prevent slipping of the cap relative to the suction cup 226 as the vial rotates (FIG. 16). The blades are described in greater detail in U.S. Pat. No. 7,770,358, supra.

Figure 23:
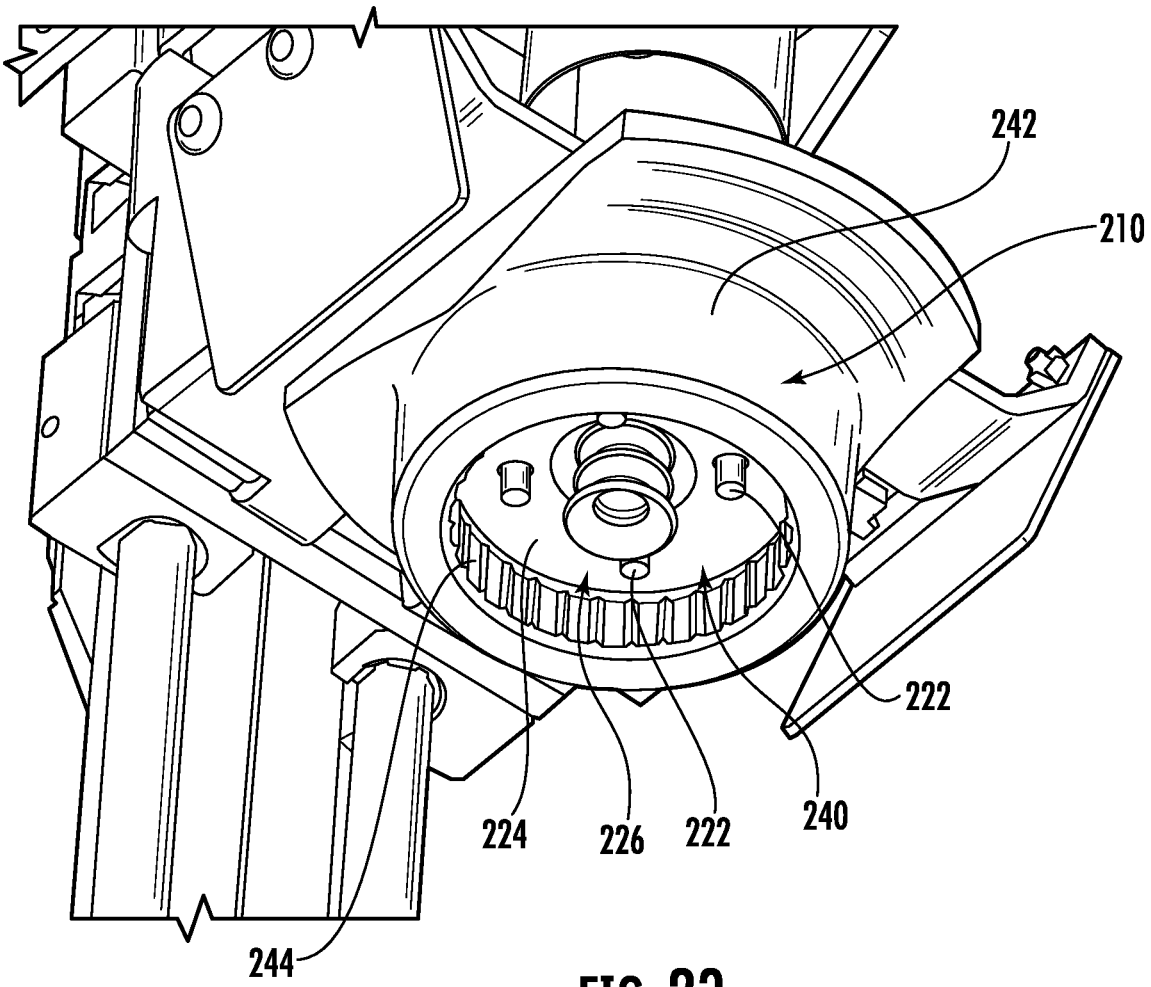
FIG. 23 is a fragmentary bottom perspective view of the carrier and core pins of FIG. 20 according to some other embodiments.

In another embodiment shown in FIG. 23, the carrier 210 includes a socket 240. The carrier 210 includes an outer circular sidewall 242 extending downwardly from the bottom surface 224 of the carrier 210, with the bottom surface 224 and the sidewall 242 defining the socket 240.

The socket 240 is sized and configured to receive a cap, with the sidewall 242 surrounding at least a portion of the outer perimeter of the cap. This may reduce or eliminate burrs that may be caused by the blades 232 described above. The socket-style carrier may simplify the alignment process and eliminate several parts.

There may be grooves 244 in the inner portion of the sidewall 242. The grooves 244 may be configured to receive ridges in the outer surface of the cap to facilitate a better grip.

Referring to FIGS. 21 and 23, it will be appreciated that the pins 222 need not extend from the bottom surface 224 of the carrier in the first or home position. That is, the pins may be held within the body of the carrier 210 or may be above the carrier 210 in the first or home position. In such an arrangement, the pins 222 may extend through apertures in the carrier 210 when the actuator 214 drives the pins 222 from the home position to the engagement position.

The vial shown in FIG. 18 may be blow molded rather than injection molded. This may lead to a substantially softer vial which is susceptible to crushing by the clamps 146*a*, 146*b*, 146*c* in the closure station 100 described in U.S. Pat. No. 8,413,410, supra. Referring to FIG. 8, a fourth cam or clamp 146*d* may be added. Like the closure station 100 described in U.S. Pat. No. 8,413,410, supra, a stop to limit rotation is provided for each clamp 146*a*, 146*b*, 146*c*, 146*d*. The stop 151 includes a main or primary body 151*b*. A finger or projection 250 extending away from the body 151 has been added to further limit rotation of the clamps 146*a*, 146*b*, 146*c*, 146*d*. These modifications may be made to reduce or even eliminate the crushing of the vials.

Figure 24:
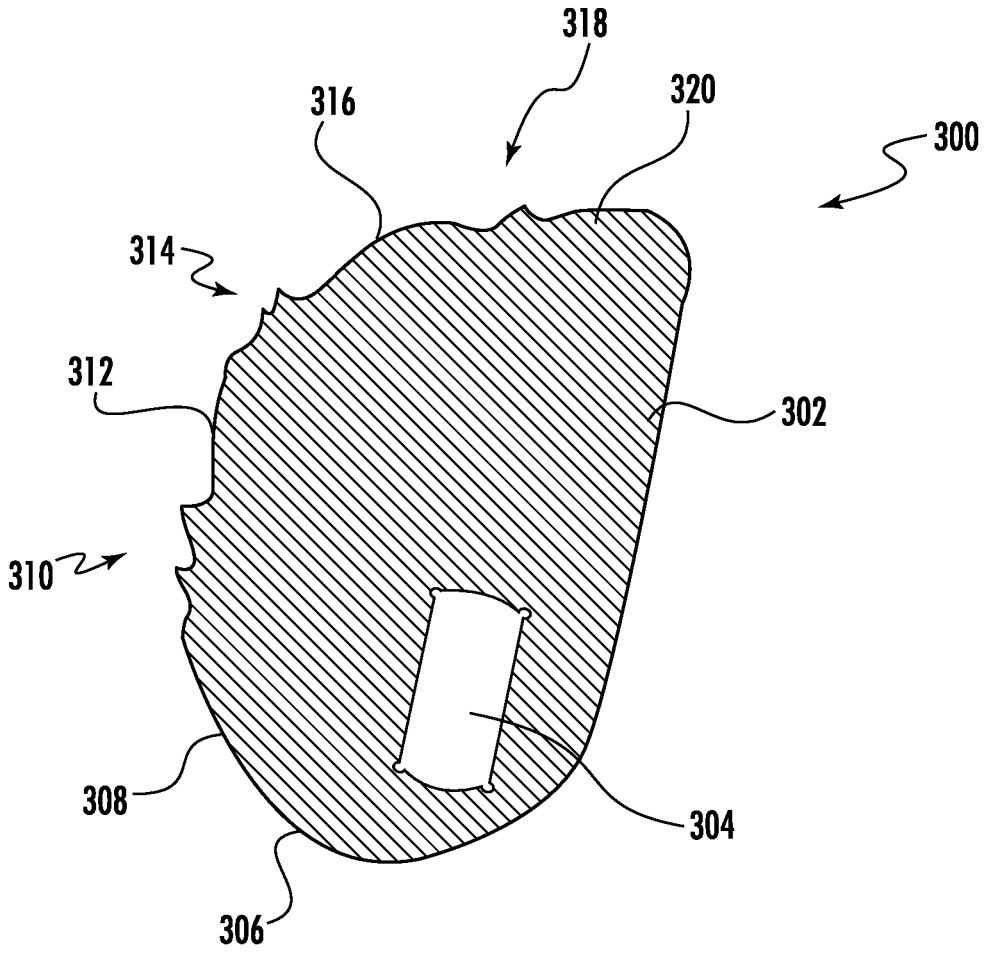
FIG. 24 is top view of a clamp for a closure station of the system of FIG. 5 according to alternative embodiments of the present invention.

Turning now to FIG. 24, a cam or clamp, designated broadly at 300, is illustrated therein. Four clamps 300 can be substituted in place of the clamps 146*a*, 146*b*, 146*c*, 146*d* and shields 150 in the closure station 100.

The clamp 300 includes a body portion 302, an oblong pivot aperture 304, and a contact edge 306. The contact edge 306, which describes generally an arc of increasing radius, can be subdivided into multiple sections: a first contact section 308; two first teeth 310; a second contact section 312; two second teeth 314; a third contact section 316; a third single tooth 318; and a fourth contact section 320.

Figure 25:
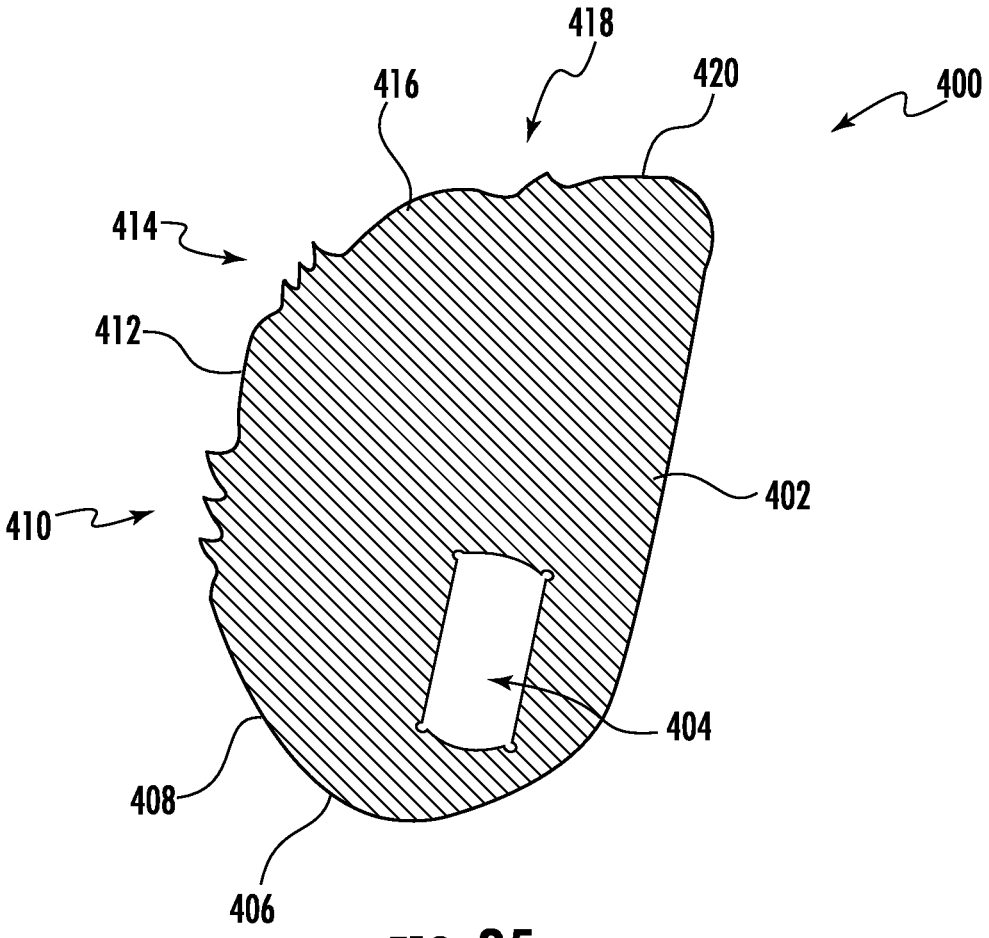
FIG. 25 is a top view of a clamp for a closure station of the system of FIG. 5 according to additional embodiments of the invention.

An alternative embodiment of a cam or clamp is shown in FIG. 25 and designated broadly at 400. Four clamps 400 can be substituted in place of the clamps 146*a*, 146*b*, 146*c*, 146*d* and shields 150 in the closure station 100.

The clamp 400 has a similarly shaped body 402, aperture 404 and edge 406 as the clamp 300, but includes three first teeth 410, three second teeth 414, and a single third tooth 418. Specifically, the contact edge 406, which describes generally an arc of increasing radius, can be subdivided into multiple sections: a first contact section 408; three first teeth 410; a second contact section 412; three second teeth 414; a third contact section 416; a third single tooth 418; and a fourth contact section 420.

The clamps 300, 400 may reduce the issue of the bottle slipping during the cap application process. Such slipping can result in loose caps and markings on the bottles. The additional teeth provide more points of contact for a better grip on the bottle. This may result in a greater holding force with less chance for slippage.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An apparatus for securing a cap on a cylindrical container, the apparatus comprising:

a stage including a receiving region for separately receiving a cap and a cylindrical container; and an elevator movable upwardly away from the stage and downwardly toward the stage, the elevator comprising:

a carrier disposed over the stage;

a capturing member on the carrier and configured to capture the cap; and at least one extendable member extending from the carrier, the at least one extendable member movable from a home position with the at least one extendable member above a center of the cap and an engagement position with the at least one extendable member engaging the center of the cap and moving the center of the cap downwardly relative to an outer sidewall of the cap.

2. The apparatus of claim 1 wherein the capturing member comprises a suction cup, and wherein the apparatus further comprises a suction source that selectively applies suction to the suction cup.

3. The apparatus of claim 2 wherein the at least one extendable member comprises a plurality of pins surrounding the suction cup.

4. The apparatus of claim 2 wherein, in the home position, the suction cup is closer to the stage than is the at least one extendable member, and wherein, in the engagement position, the at least one extendable member is closer to the stage than is the suction cup.

5. The apparatus of claim 1 further comprising an actuator above or on the carrier, wherein the actuator is configured to drive the at least one extendable member from the home position to the engagement position.

6. The apparatus of claim 5 wherein the actuator comprises a pneumatic cylinder.

7. The apparatus of claim 5 wherein the at least one extendable member extends from the actuator to the carrier.

8. The apparatus of claim 5 wherein the actuator is configured to retract the at least one extendable member from the engagement position to the home position.

9. The apparatus of claim 1 further comprising a plurality of blades on a bottom surface of the carrier and surrounding the capturing member, wherein blade edges of the blades are positioned to engage a circumferential edge of the cap when the cap is being secured to the cylindrical container.

10. The apparatus of claim 9 wherein the at least one extendable member comprises a plurality of pins with each pin being between adjacent ones of the blades.

11. The apparatus of claim 1 wherein the carrier comprises an outer sidewall extending downwardly from a bottom surface of the carrier, the outer sidewall of the carrier and the bottom surface defining a socket that is sized and configured to receive the cap with a circumferential edge of the cap adjacent to and/or engaging the outer sidewall of the carrier.

12. The apparatus of claim 11 wherein an inner surface of the outer sidewall of the carrier comprises grooves in which ridges of the circumferential edge of the cap can be received.

13. The apparatus of claim 1 further comprising a centering assembly comprising a plurality of clamps that are configured to sequentially center the cap and the container on the stage.

14. The apparatus of claim 13 wherein each clamp comprises an arcuate contact edge comprising first through fourth contact sections, two or three first teeth between the first and second contact sections, two or three second teeth between the second and third contact sections, and a single third tooth between the third and fourth contact sections.

15. The apparatus of claim 13 further comprising a stop for each clamp, wherein the stop comprises a main body and a finger extending away from the main body toward its corresponding clamp.

16. The apparatus of claim 1 wherein the at least one extendable member comprises at least one pin.

17. The apparatus of claim 1 wherein the movement of the center of the cap relative to the outer sidewall of the cap, caused by the extendable member, manipulates the cap between different child-resistant and non-child resistant configurations.

* * * * *